US008369747B2

(12) United States Patent
Ueji et al.

(10) Patent No.: US 8,369,747 B2
(45) Date of Patent: Feb. 5, 2013

(54) CHARGING DEVICE AND IMAGE FORMING APPARATUS

(75) Inventors: Masaki Ueji, Osaka (JP); Hiroo Naoi, Osaka (JP); Toshiaki Ino, Osaka (JP); Katsuya Takano, Osaka (JP); Yasuhiro Nishimura, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 324 days.

(21) Appl. No.: 12/894,373

(22) Filed: Sep. 30, 2010

(65) Prior Publication Data

US 2011/0081161 A1 Apr. 7, 2011

(30) Foreign Application Priority Data

Oct. 1, 2009 (JP) ..... 2009-230007

(51) Int. Cl.
*G03G 15/02* (2006.01)
*G03G 15/14* (2006.01)

(52) U.S. Cl. ..... 399/172; 399/93; 399/100; 399/115; 399/170

(58) Field of Classification Search ..... 399/50, 399/92, 93, 98–100, 115, 168, 170–173
See application file for complete search history.

(56) References Cited

U.S. PATENT DOCUMENTS

| | | | | |
|---|---|---|---|---|
| 2006/0093394 | A1* | 5/2006 | Shirakata | 399/93 |
| 2007/0212111 | A1* | 9/2007 | Kagawa et al. | 399/168 |
| 2008/0226334 | A1* | 9/2008 | Ohno et al. | 399/100 |

FOREIGN PATENT DOCUMENTS

| | | | |
|---|---|---|---|
| JP | 2-105172 A | | 4/1990 |
| JP | 2003043894 A | * | 2/2003 |
| JP | 2003-122187 A | | 4/2003 |
| JP | 2007-072212 | | 3/2007 |
| JP | 2009-069300 | | 4/2009 |

* cited by examiner

*Primary Examiner* — Walter L Lindsay, Jr.
*Assistant Examiner* — Jessica L Eley
(74) *Attorney, Agent, or Firm* — Renner, Otto, Boisselle & Sklar, LLP

(57) ABSTRACT

A charging device is provided. A charging device includes a charging section and a discharge product adsorption removal section. The charging section includes a shield case having a shield opening, a discharge electrode, and a rotation shaft which is parallel to a rotation axis of a photoreceptor. The discharge product adsorption removal section has an adsorption layer that adsorbs a discharge product and is disposed downward in a vertical direction of the photoreceptor. The charging section is displaceable about an axial line of the rotation shaft from a position where the shield opening opposes to the photoreceptor to a position where the shield opening opposes to the discharge product adsorption removal section.

9 Claims, 13 Drawing Sheets

CHARGING DEVICE AND IMAGE FORMING APPARATUS

CROSS-REFERENCE TO RELATED APPLICATION

This application claims priority to Japanese Patent Application No. 2009-230007, which was filed on Oct. 1, 2009, the content of which is incorporated herein by reference in its entirety.

BACKGROUND OF THE INVENTION

1. Field of the Invention

The present invention relates to a charging device and an image forming apparatus provided with the device apparatus.

2. Description of the Related Art

In an image forming apparatus of an electrophotographic type, a charging device of a corona discharge type is used as a charging section which uniformly charges a photoreceptor which is an image bearing member to bear an electrostatic latent image thereon. Such a charging device of a corona discharge type is provided with a shield case having an opening opposing to a photoreceptor and a discharge electrode disposed in a stretched manner inside the shield case whose discharging surface is a linear, a pin array, or a needle shape. The charging device is a so-called corotron which charges a photoreceptor uniformly by applying high voltage to the discharge electrode so that a corona discharge is generated, or a so-called scorotron which provides a grid electrode between the discharge electrode and the photoreceptor so as to charge the photoreceptor uniformly by applying desired voltage to the grid electrode.

In the charging device of a corona discharge type, a discharge product such as nitrogen oxide (NOx) is produced. To be specific, by the energy released from the charging device along with the discharge of electrons, nitrogen molecule ($N_2$) present in the air is dissociated into nitrogen atom (N), and the nitrogen atom is combined with oxygen molecule ($O_2$) to thereby generate nitrogen oxide (nitrogen dioxide: $NO_2$).

When nitrogen oxide is generated in this manner, the nitrogen oxide is adhered to the photoreceptor as ammonium salt (ammonium nitrate), which will be a cause of an abnormal image. In particular, in a case where an organic photoreceptor (OPC) is used as the photoreceptor, the image defection such as white voids or image deletion easily occurs by the nitrogen oxide.

To solve such a problem, Japanese Unexamined Patent Publication JP-A 2003-122187 discloses an image forming apparatus with a configuration in which a brush roller containing zeolite is caused to abut on an upward side of a photoreceptor. Furthermore, JP-A 2003-122187 discloses an image forming apparatus with a configuration in which a plate-like member containing zeolite is arranged on the upward side of the photoreceptor so as to oppose to the photoreceptor.

According to the image forming apparatus disclosed in JP-A 2003-122187, zeolite contained in the brush roller and the plate-like member has a property to adsorb the nitrogen oxide and the ammonium nitrate, and thereby it is possible to adsorb and remove the ammonium nitrate adhered on a surface of the photoreceptor with the brush roller to be frictionally sliding thereon, and adsorb and remove the discharge product such as nitrogen oxide floated in the air in a vicinity of the photoreceptor with the plate-like member. Thereby, it is possible to suppress occurrence of the image defection caused by the discharge product such as the ammonium nitrate adhered to the photoreceptor, nitrogen oxide floated in the air in the vicinity of the photoreceptor, and the like.

However, in the image forming apparatus disclosed in JP-A 2003-122187, since the brush roller containing zeolite adsorbs and removes the ammonium nitrate adhered on the photoreceptor by frictionally sliding thereon, there is a possibility that a scratch occurs on a surface of the photoreceptor and thereby the image defection due to the scratch occurs. Furthermore, in the image forming apparatus disclosed in JP-A 2003-122187, since the plate-like member containing zeolite is arranged on an upward side of the photoreceptor, it is impossible to remove the discharge product that flows toward downward side along the surface of the photoreceptor. Therefore, the image forming apparatus disclosed in JP-A 2003-122187 is not capable of sufficiently preventing occurrence of the image defection such as white voids or image deletion caused by the discharge product such as nitrogen oxide. Moreover, in the case of the charging device with a configuration in which the discharge electrode is provided in a stretched manner inside the shield case, the discharge product is retained at high concentrations in an inner space of the shield case after discharge operation, however, a configuration in which the discharge product retained in the inner space of the shield case is able to be removed without degrading charging performance is not disclosed in JP-A 2003-122187.

SUMMARY OF THE INVENTION

Therefore, an object of the invention is to provide a charging device capable of sufficiently removing a discharge product such as nitrogen oxide which is generated in charging a surface of a photoreceptor without degrading charging performance, and capable of preventing occurrence of image defection such as white voids or image deletion caused by the discharge product, and an image forming apparatus provided with the same.

The invention provides a charging device comprising:

a charging section for charging a surface of a photoreceptor which is provided to be rotatable about a rotation axis; and a discharge product adsorption removal section provided on a downward side in a vertical direction of the photoreceptor and having an adsorption layer composed of an adsorbent that adsorbs a discharge product generated in charging the surface of the photoreceptor by the charging section, the charging section including:

- a shield case having a longitudinal axis parallel to the rotation axis of the photoreceptor and having a shield opening which faces and opens in one direction perpendicular to the longitudinal axis,
- a discharge electrode provided in the shield case in parallel with the longitudinal axis, and
- a rotation shaft to which the shield case is fixed and which is disposed to be rotatable about an axial line parallel to the longitudinal axis, and the rotation shaft being rotatable from a position where the shield opening opposes to the photoreceptor to a position where the shield opening opposes to the discharge product adsorption removal section.

According to the invention, the charging device includes a charging section that charges a surface of a photoreceptor and a discharge product adsorption removal section. The charging section includes a shield case having a shield opening, a discharge electrode disposed inside the shield case and a rotation shaft to which the shield case is fixed. Then, the discharge product adsorption removal section is provided on a downward side in a vertical direction of the photoreceptor and has an adsorption layer composed of an adsorbent which adsorbs the discharge product generated in charging the surface of the photoreceptor by the charging section.

Since molar weight of nitrogen monoxide (NO) is 30.0 g/mol, molar weight of nitrogen dioxide ($NO_2$) is 46.0 g/mol, and molar weight of air is 28.9 g/mol, the discharge product such as nitrogen oxide composed of nitrogen monoxide and nitrogen dioxide is heavier than air. Therefore, the discharge product generated in charging the surface of the photoreceptor by the charging section flows downward in the vertical direction along the surface of the photoreceptor.

Contrary to this, in the charging device according to the invention, since the discharge product adsorption removal section having the adsorption layer of adsorbing the discharge product is disposed on the downward side in the vertical direction of the photoreceptor, the discharge product floated in the air in the vicinity of the photoreceptor and flowing downward in the vertical direction along the surface of the photoreceptor is able to be adsorbed and removed efficiently. Thereby, the charging device is capable of preventing occurrence of the image defection such as white voids or image deletion caused by the discharge product.

Further, in the charging device with the configuration in which the discharge electrode is disposed inside the shield case, the discharge product is retained at high concentrations in an inner space of the shield case after discharge operation by the discharge electrode. Therefore, in the charging device according to the invention, the rotation shaft to which the shield case is fixed is provided to be rotatable from a position where the shield opening opposes to the photoreceptor to a position where the shield opening opposes to the discharge product adsorption removal section.

In the charging device, when the charging section is displaced so that the shield opening opposes to the photoreceptor, the surface of the photoreceptor is able to be charged, and when the charging section is displaced so that the shield opening opposes to the discharge product adsorption removal section, the discharge product retained in the inner space of the shield case is able to be removed efficiently. Therefore, the charging device is capable of adsorbing and removing the discharge product retained in the inner space of the shield case without degrading charging performance, and capable of preventing occurrence of image defection such as white voids or image deletion caused by the discharge product.

Further, in the invention, it is preferable that the charging section and the discharge product adsorption removal section are arranged side by side in this order downward in the vertical direction of the photoreceptor, and the charging section is rotated by 180° about the axial line of the rotation shaft and thereby the shield opening of the shield case is displaced from a position opposing to the photoreceptor to a position opposing to the discharge product adsorption removal section.

According to the invention, the charging section and the discharge product adsorption removal section are arranged side by side in this order downward in the vertical direction of the photoreceptor. Then the charging section is so configured that by rotation thereof by 180° about the axial line of the rotation shaft and thereby the shield opening of the shield case is displaced from a position opposing to the photoreceptor to a position opposing to the discharge product adsorption removal section. In the charging device configured in this manner, the discharge product adsorption removal section is arranged downward in the vertical direction of the photoreceptor, and thereby it is possible to improve efficiency of adsorbing and removing the discharge product floated in the air in the vicinity of the photoreceptor and flowing downward in the vertical direction along the surface of the photoreceptor by the discharge product adsorption removal section.

Further, in the invention, it is preferable that the charging device further comprises an exhaust section which generates airflow flowing from one end to another end in the rotation axis of the photoreceptor, and the discharge product adsorption removal section extends along the rotation axis of the photoreceptor and is formed into a case shape, and is configured to have an adsorption opening extending along the rotation axis of the photoreceptor to open, and airflow passage openings which open at both ends in its longitudinal axis parallel to the rotation axis of the photoreceptor and through which airflow generated by the exhaust section passes, and the adsorption layer is formed on a bottom surface facing the adsorption opening, and the rotation shaft is rotatable from the position where the shield opening opposes to the photoreceptor to the position where the shield opening opposes to the adsorption opening of the discharge product adsorption removal section.

According to the invention, the charging device further includes an exhaust section which generates airflow flowing from one end to another end in the rotation axis of the photoreceptor. Additionally, the discharge product adsorption removal section extends along the rotation axis of the photoreceptor and is formed into a case shape, and is configured to have an adsorption opening extending along the rotation axis of the photoreceptor to open, and airflow passage openings which open at both ends in its longitudinal axis parallel to the rotation axis of the photoreceptor and through which airflow generated by the exhaust section passes, and an adsorption layer is formed on a bottom surface opposing to the adsorption opening. Then, the rotation shaft to which the shield case is fixed is provided to be rotatable from the position where the shield opening opposes to the photoreceptor to the position where the shield opening opposes to the discharge product adsorption removal section.

In a charging device configured in such a manner, the airflow generated by the exhaust section passes through the airflow passage openings in the discharge product adsorption removal section and thereby flows downward in the vertical direction along the surface of the photoreceptor, and the discharge product proceeded into the inner space of the discharge product adsorption removal section formed into a case shape is guided by the airflow to be in contact with the adsorption layer which is formed on the bottom surface of the discharge product adsorption removal section. Thereby the efficiency of adsorbing and removing discharge product by the discharge product adsorption removal section is able to be improved.

Further, the airflow generated by the exhaust section passes through the airflow passage openings in the discharge product adsorption removal section even in a case where the charging section is displaced so that the shield opening opposes to the adsorption opening of the discharge product adsorption removal section, and thereby the discharge product retained in the inner space of the shield case is guided by the airflow to be in contact with the adsorption layer formed on the bottom surface of the discharge product adsorption removal section. Thereby, the efficiency of adsorbing and removing discharge product retained in the inner space of the shield case by the discharge product adsorption removal section is able to be improved.

Further, in the invention, it is preferable that the adsorbent constituting the adsorption layer is zeolite.

According to the invention, it is preferable that the adsorbent constituting the adsorption layer of the discharge product adsorption removal section is zeolite. Zeolite is a material which is excellent in adsorption performance for the discharge product, and therefore, the efficiency of adsorbing and removing discharge product by the discharge product adsorption removal section is able to be improved.

Further, in the invention, it is preferable that the adsorption layer has a thickness of 40 to 100 μm.

According to the invention, it is preferable that the adsorption layer has a thickness of 40 to 100 μm. Thereby the ability to adsorb and remove the discharge product by the discharge adsorption removal section is maintained over a long term.

Further, in the invention, it is preferable that the charging device further comprises a rotation control section that controls rotation driving operation about an axis of the rotation shaft in the charging device, and the rotation control section includes:

a stop signal reception portion that receives a photoreceptor stop signal indicating an instruction to stop rotation driving operation of the photoreceptor, an elapsed time measuring portion that measures an elapsed time since the charging section is rotationally driven and the shield opening of the shield case is maintained at a position opposing to the discharge product adsorption removal section, and a rotation driving control portion that controls rotation driving of the charging section so that the shield opening is displaced from the position opposing to the photoreceptor to the position opposing to the discharge product adsorption removal section in the case where the stop signal reception portion has received the photoreceptor stop signal, and so that the shield opening is displaced from the position opposing to the discharge product adsorption removal section to the position opposing to the photoreceptor in the case where the elapsed time measured by the elapsed time measuring portion reaches a predetermined first threshold value.

According to the invention, the charging device further includes a rotation control section that controls rotation driving operation of the charging section. The rotation control section includes a stop signal reception portion, an elapsed time measuring portion, and a rotation driving control portion. The stop signal reception portion receives a photoreceptor stop signal indicating an instruction to stop the rotation driving operation of the photoreceptor. The elapsed time measuring portion measures an elapsed time since the charging section is rotationally driven and the shield opening is maintained at the position opposing to the discharge product adsorption removal section. Then, the rotation driving control portion controls rotation driving of the charging section so that the shield opening is displaced from the position opposing to the photoreceptor to the position opposing to the discharge product adsorption removal section in the case where the stop signal reception portion has received the photoreceptor stop signal. The charging device is thereby able to efficiently adsorb and remove the discharge product retained in the inner space of the shield case by the discharge product adsorption removal section. Moreover, the rotation driving control portion controls rotation driving of the charging section so that the shield opening is displaced from the position opposing to the discharge product adsorption removal section to the position opposing to the photoreceptor in the case where the elapsed time measured by the elapsed time measuring portion reaches a predetermined first threshold value. The charging device is thereby able to prepare so that charging operation to charge the surface of the photoreceptor is able to be performed smoothly.

Further, in the invention, it is preferable that the rotation control section further comprises a humidity data reception portion that receives humidity data indicating humidity in the vicinity of the charging section, and the rotation driving control portion, when the elapsed time measured by the elapsed time measuring portion reaches a first threshold value, judges whether or not the humidity data received by the humidity data reception portion is the predetermined value or less, and in the case of judging the humidity data to be the predetermined value or less, controls rotation driving of the charging section so that the shield opening is displaced from the position opposing to the discharge product adsorption removal section to the position opposing to the photoreceptor when the elapsed time measured by the elapsed time measuring portion reaches a predetermined second threshold value exceeding the first threshold value.

According to the invention, the rotation control section further includes a humidity data reception portion that receives humidity data indicating humidity in the vicinity of the charging section. Then, the rotation driving control portion, when the elapsed time measured by the elapsed time measuring portion reaches a first threshold value, judges whether or not the humidity data received by the humidity data reception portion is the predetermined value or less. Then, the rotation driving control portion, in the case of judging the humidity data to be the predetermined value or less, controls rotation driving of the charging section so that the shield opening is displaced from the position opposing to the discharge product adsorption removal section to the position opposing to the photoreceptor when the elapsed time measured by the elapsed time measuring portion reaches a predetermined second threshold value exceeding the first threshold value.

A generation amount of the discharge product generated in charging the surface of the photoreceptor by the charging section varies depending on a humidity condition in the vicinity of the charging section, and along with decrease of humidity, the generation amount of the discharge product increases. Contrary to this, in the case where humidity in the vicinity of the charging section is a predetermined value of less, the rotation driving control portion controls rotation driving of the charging section so that the shield opening is displaced from the position opposing to the discharge product adsorption removal section to the position opposing to the photoreceptor when the elapsed time measured by the elapsed time measuring portion reaches the second threshold value exceeding the first threshold value. Thus, when humidity in the vicinity of the charging section is the predetermined value or less, the elapsed time since the shield opening is maintained at the position opposing to the discharge product adsorption removal section is able to extend, and therefore, it is possible to sufficiently adsorb and remove the discharge product by the discharge product adsorption removal section even in the case where the humidity is the predetermined value or less and a large amount of discharge product is retained in the inner space of the shield case.

Further, in the invention, it is preferable that the rotation control section further comprises a driving time data reception portion that receives driving time data indicating a photoreceptor driving time that the photoreceptor is rotationally driven, and the rotation driving control portion, when an elapsed time measured by the elapsed time measuring portion reaches a first threshold value, judges whether or not driving time data received by the driving time data reception portion is a predetermined value or more, and in the case of judging the driving time data to be the predetermined value or more, controls rotation driving of the charging section so that the shield opening is displaced from the position opposing to the discharge product adsorption removal section to the position opposing to the photoreceptor when the elapsed time measured by the elapsed time measuring portion reaches a predetermined second threshold value exceeding the first threshold value.

According to the invention, the rotation control section further includes a driving time data reception portion that receives driving time data indicating a photoreceptor driving time that the photoreceptor is rotationally driven. Then, the rotation driving control portion, when the elapsed time measured by the elapsed time measuring portion reaches a first threshold value, judges whether or not the driving time data received by the driving time data reception portion is a predetermined value or more. Then, the rotation driving control portion, in the case of judging the driving time data to be the predetermined value or more, controls rotation driving of the charging section so that the shield opening is displaced from the position opposing to the discharge product adsorption removal section to the position opposing to the photoreceptor when the elapsed time measured by the elapsed time measuring portion reaches a predetermined second threshold value exceeding the first threshold value.

The longer the time that the photoreceptor is rotationally driven to be charged, that is, the longer the photoreceptor driving time is, the generation amount of the discharge product increases. Contrary to this, the rotation driving control portion, in the case where the photoreceptor driving time is a predetermined value of more, controls rotation driving of the charging section so that the shield opening is displaced from the position opposing to the discharge product adsorption removal section to the position opposing to the photoreceptor when the elapsed time measured by the elapsed time measuring portion reaches the second threshold value exceeding the first threshold value. Thus, when the photoreceptor driving time is the predetermined value of more, the elapsed time since the shield opening is maintained at a position opposing to the discharge product adsorption removal section is able to extend, and therefore, it is possible to sufficiently adsorb and remove the discharge product by the discharge product adsorption removal section even in a case where the photoreceptor driving time is the predetermined value or more and a large amount of discharge product is retained in the inner space of the shield case.

Further, the invention provides an image forming apparatus comprising a photoreceptor, a charging device mentioned above that charges a surface of the photoreceptor, an exposure section that irradiates a signal light based on image information on the surface of the photoreceptor in a charged state to form an electrostatic latent image, a developing section that develops the electrostatic latent image on the surface of the photoreceptor to form a toner image, a transfer section that transfers the toner image onto a recording medium, and a fixing section that fixes the toner image transferred on the recording medium.

According to the invention, the image forming apparatus, by including the charging device mentioned above, is able to be prevented from occurrence of the image defection such as white voids or image deletion caused by the discharge product, and thus a high quality image is able to be formed over a long term.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
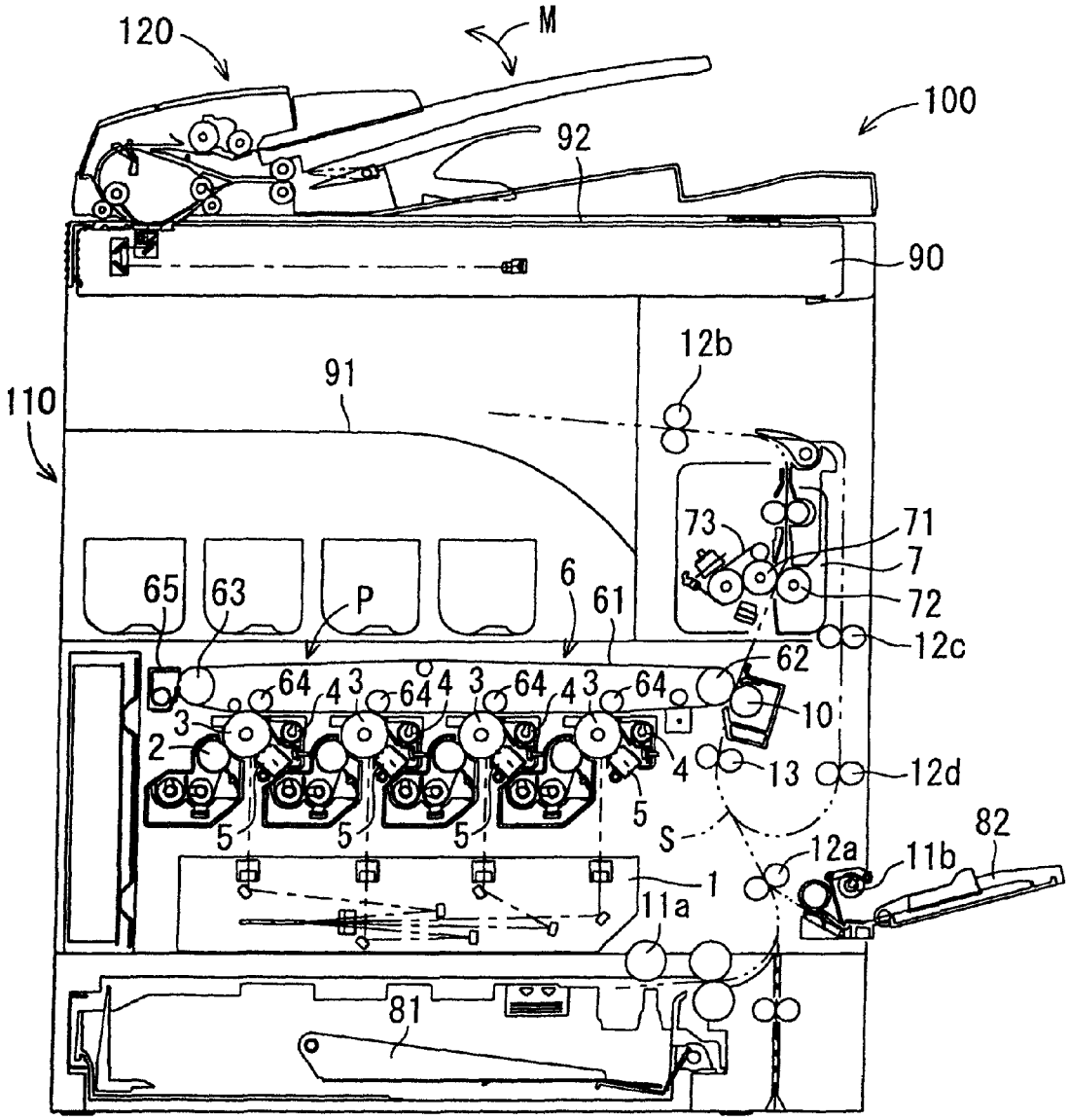
FIG. 1 is a drawing showing a configuration of an image forming apparatus according to an embodiment of the invention.

Now referring to the drawings, preferred embodiments of the invention are described below.

(Image Forming Apparatus)

Figure 2:
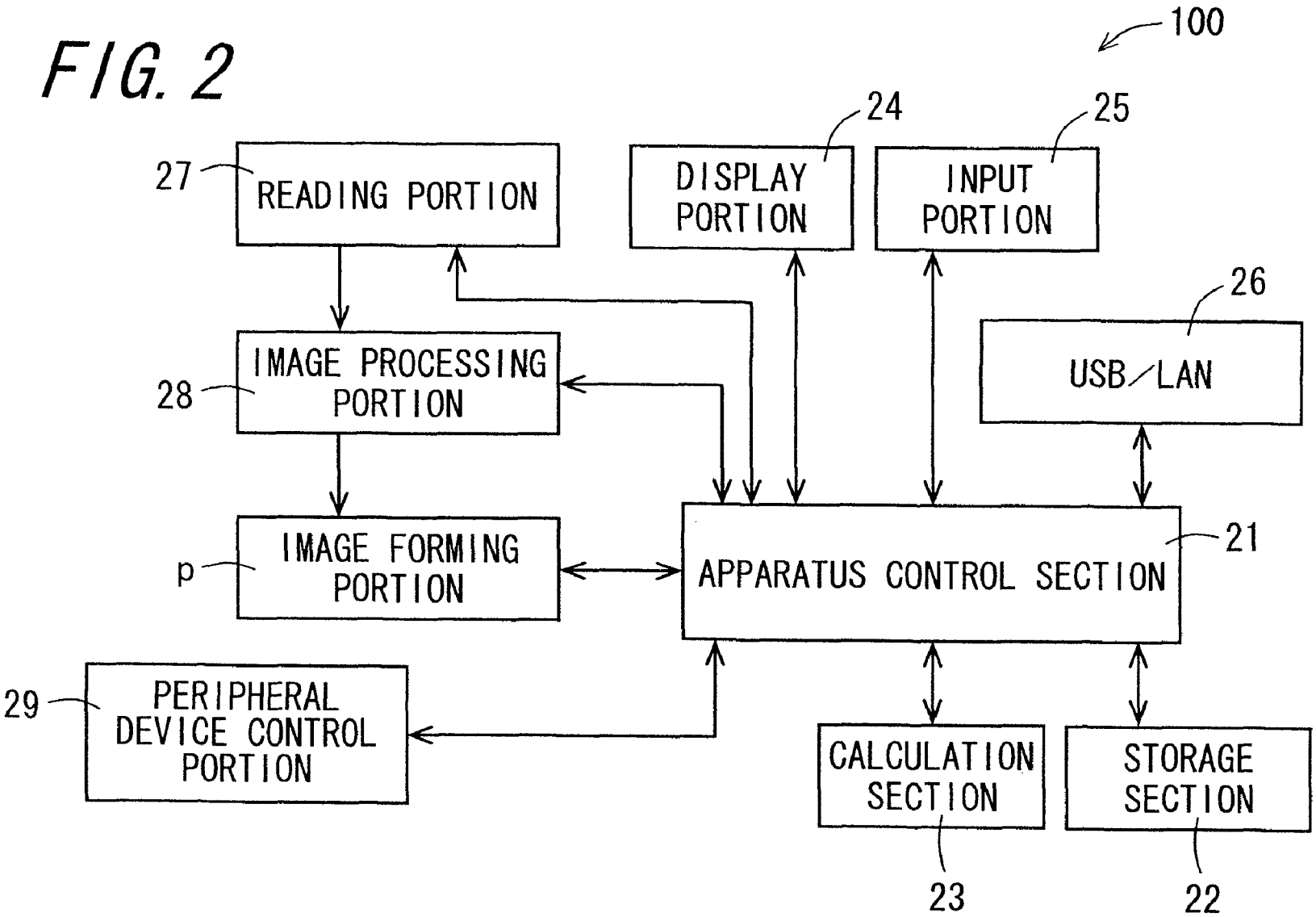
FIG. 2 is a block diagram showing an electrical configuration of the image forming apparatus.

FIG. 1 is a drawing showing a configuration of an image forming apparatus 100 according to an embodiment of the invention. Further, FIG. 2 is a block diagram showing an electrical configuration of the image forming apparatus 100. The image forming apparatus 100 is an apparatus of forming an image in multicolor or in monochrome for a recording paper which is a recording medium, based on image data transmitted from an outside or image data obtained by reading a document, and includes an apparatus main body 110 and an automatic document processing apparatus 120.

The apparatus 110 includes an exposure unit 1, four image forming portions P, an intermediate transfer unit 6 including an intermediate transfer belt 61, a fixing unit 7, an inner paper feed unit 81, a manual paper feed unit 82, and a paper discharge unit 91. On an upper part of the apparatus main body 110, a document platen 92 composed of a transparent glass on which a document is placed is disposed, and on an upper side of the document platen 92, an automatic document processing apparatus 120 is attached. The automatic document processing apparatus 120 automatically conveys a document onto the document platen 92. Moreover, the automatic document processing apparatus 120 is configured to freely pivot in an arrow M direction and it is possible to place a document manually by opening a top of the document platen 92.

The image forming apparatus 100 performs an image formation in an image forming portion P by using image data corresponding to each of four colors including black (K) as well as cyan (C), magenta (M), and yellow (Y) which are three primary colors of subtractive mixture which are obtained by color separation of a color image. The four image forming portions P are arranged in a line in a moving direction (rotating direction) of the intermediate transfer belt 61.

Each of the four image forming portions P is configured similarly and has a developing unit 2, a photoreceptor 3, a cleaner unit 4, and a charging device 5 according to the invention. The photoreceptor 3 is an image bearing member, and around which the developing unit 2, the cleaner unit 4 and the charging device 5 are arranged. In addition, in each developing unit 2 of four image forming portions P, each color toner of yellow (Y), magenta (M), cyan (C), and black (K) is contained.

The photoreceptor 3 is in the shape of a cylindrical drum and rotationally driven about the axis by a driving section (not shown). The photoreceptor 3 has a conductive substrate of a cylindrical shape and a photoconductive layer disposed on a surface of the conductive substrate.

The charging device 5, although details thereof will be described below, faces the photoreceptor 3 and is arranged to be separated from a surface of the photoreceptor 3 having a gap therebetween along an axial direction of the photoreceptor 3. The charging device 5 is a charger type device and charges the surface of the photoreceptor 3 uniformly to predetermined potential.

The exposure unit 1 is a laser scanning unit (LSU) including a laser emitting portion, a reflection mirror and the like. The exposure unit 1 is configured by including a laser emitting portion for emitting a laser light which is modulated corresponding to image data transmitted from the automatic document processing apparatus 120 or the outside, a polygon mirror for deflecting the laser light emitted from the laser emitting portion in a main scanning direction, and a convergent lens for converging the laser light deflected in the main scanning direction by the polygon mirror so as to form an image on the surface of the photoreceptor 3, and a reflection mirror for reflecting the laser light converged by the convergent lens. The laser light emitted by the laser emitting portion is deflected by the polygon mirror and further converged by the convergent lens, reflected by the reflection mirror, irradiated to the surface of the photoreceptor 3 which is charged to predetermined potential and polarity, and thereby an electrostatic latent image corresponding to image data is formed to the photoreceptor 3. Note that, as the exposure unit 1, other than the laser scanning unit (LSU), a writing apparatus (for example, writing head) in which light emitting elements such as an EL (Electro Luminescence) or an LED (Light Emitting Diode) are arranged in an array is usable.

The developing unit 2 is disposed to oppose to and to be in pressure-contact with the photoreceptor 3, and visualize an electrostatic latent image by supplying a toner which is a developer to the electrostatic latent image formed on the surface of the photoreceptor 3.

The cleaner unit 4 removes and collects a toner remaining on the surface of the photoreceptor 3 after development and image transfer.

The intermediate transfer unit 6 is arranged above the photoreceptor 3 and provided with the intermediate transfer belt 61, an intermediate transfer belt driving roller 62, an intermediate transfer belt driven roller 63, a primary transfer roller 64, and an intermediate transfer belt cleaning unit 65.

The intermediate transfer belt 61 is an endless-shaped belt member which is supported around the intermediate transfer belt driving roller 62 and the intermediate transfer belt driven roller 63 with tension to form a loop shaped moving path, and a thickness thereof is approximately 100 μm to 150 μm. The primary transfer roller 64 is arranged at a position opposing to the photoreceptor 3 with the intermediate transfer belt 61 interposed therebetween. A position where the intermediate transfer belt 61 opposes to the photoreceptor 3 is a primary transfer position.

To the primary transfer roller 64, a primary transfer bias of a polarity opposite to a charging polarity of a toner is applied by constant voltage control for transferring a toner image borne on the surface of the photoreceptor 3 onto the intermediate transfer belt 61. Thereby toner images of each of colors formed on the photoreceptor 3 are sequentially transferred to and overlaid on an outer circumferential surface of the intermediate transfer belt 61, and thus a full-color toner image is formed on the outer circumferential surface of the intermediate transfer belt 61. However, when image data for only a part of the colors of yellow, magenta, cyan and black is inputted, electrostatic latent images and toner images are formed at only a part corresponding to the color of the input image data among each of the photoreceptors 3 of the four image forming portions P. For example, during monochrome image formation, formation of an electrostatic latent image and formation of a toner image are performed only at the photoreceptor 3 corresponding to the color of black, and only a black toner image is transferred onto the outer circumferential surface of the intermediate transfer belt 61. The primary transfer roller 64 is configured by coating a surface of a shaft whose raw material is metal having a diameter of 8 to 10 mm (stainless steel, for example) with a conductive elastic material (such as EPDM: ethylene-propylene copolymer rubber, urethane foam, etc.), and high voltage is applied uniformly to the intermediate transfer belt 61 by the conductive elastic material.

The toner image transferred onto the outer circumferential surface of the intermediate transfer belt 61 by the primary transfer roller 64 is conveyed to a secondary transfer position, which is a position opposing to the secondary transfer roller 10, by the rotation of the intermediate transfer belt 61.

The secondary transfer roller 10 is in pressure-contact, at predetermined nip pressure, with the outer circumferential surface of the intermediate transfer belt 61 whose inner circumferential surface is in contact with a circumferential surface of an intermediate transfer belt driving roller 62 during image formation. When recording paper fed from the inner paper feed unit 81 or a manual paper feed unit 82 passes through between the secondary transfer roller 10 and the intermediate transfer belt 61, high voltage with a polarity opposite to the charging polarity of the toner is applied to the secondary transfer roller 10. Thereby the toner image is transferred from the outer circumferential surface of the intermediate transfer belt 61 to the surface of the recording paper. Furthermore, to obtain the nip pressure constantly at the secondary transfer position, either one roller of the secondary transfer roller 10 and the intermediate transfer belt driving roller 62 is composed of a hard material such as metal, and another roller is composed of a soft material such as elastic rubber or foamable resin.

A toner remaining on the intermediate transfer belt 61 which has not been transferred onto the recording paper among toners adhered to the intermediate transfer belt 61 from a part of or an entirety of the photoreceptor 3 is removed and collected by the intermediate transfer belt cleaning unit 65 so as to prevent color mixture at the next step. In the intermediate transfer belt cleaning unit 65, a cleaning blade for removing a toner by abutting on the intermediate transfer belt 61 is provided.

The fixing unit 7 has a heat roller 71 and a pressure roller 72. The recording paper to which the toner image is transferred is guided to the fixing unit 7 and heated and pressurized by passing through between the heat roller 71 and the pressure roller 72. Thereby, the toner image is fixed firmly on the surface of the recording paper. Note that, an external fixing belt 73 for heating the heat roller 71 from the outside is disposed by being in contact with the heat roller 71, and the heat roller 71 is controlled to be a predetermined fixing temperature based on temperature data detected by a temperature detecting device (not shown). The recording paper on which the toner image is fixed is discharged onto the paper discharge unit 91 by conveying rollers **12*b***.

In the image forming apparatus 100, a paper conveyance path S extending in a substantially vertical direction for sending the recording paper contained in the inner paper feed unit 81 and the manual paper feed unit 82 through a region between the secondary transfer roller 10 and the intermediate transfer belt 61 and through the fixing unit 7 to the paper discharge unit 91. Arranged in a vicinity of the paper conveyance path S are a pick-up rollers 11*a* and 11*b*, a plurality of conveying rollers 12*a* to 12*d*, and registration rollers 13.

The plurality of conveying rollers 12*a* to 12*d* are small size rollers for promoting and aiding the conveyance of the recording paper, respectively, and are disposed along the paper conveyance path S. The pick-up roller 11*a* is provided in the vicinity of an end of the inner paper feed unit 81 and supplies to the paper conveyance path S by picking up the recording paper sheet by sheet from the inner paper feed unit 81. The pick-up roller 11*b* is provided in the vicinity of an end of the manual paper feed unit 82 and supplies to the paper conveyance path S by picking up the recording paper sheet by sheet from the manual paper feed unit 82.

The registration rollers 13 are to temporarily hold the recording paper which is being conveyed on the paper conveyance path S. Then, the registration rollers 13 have a function of conveying the recording paper between the secondary transfer roller 10 and the intermediate transfer belt 61 at timing of registering a leading end of the toner image on the photoreceptor 3 and a leading end of the recording paper.

In the image forming apparatus 100, the recording paper conveyed from the inner paper feed unit 81 and the manual paper feed unit 82 is conveyed to the registration rollers 13 by the conveying rollers 12*a* of the paper conveyance path S, conveyed to the secondary transfer roller 10 at a predetermined timing by the registration rollers 13 and when passing through between the secondary transfer roller 10 and the intermediate transfer belt 61, a toner image is transferred thereon. The recording paper on which the toner image is transferred passes through the fixing unit 7 and thereby the toner image is fused and fixed with heat and discharged onto the paper discharge unit 91 through the conveying rollers 12*b*.

Further, in a case of double-sided printing in which an image is formed on both sides of the paper, the recording paper which a single-sided printing has been completed passing through the fixing unit 7 is guided to the conveying rollers 12*c* and 12*d* by reverse rotation of the conveying rollers 12*b* when a tail end of the recording paper is held by the conveying rollers 12*b*. The recording paper guided by the conveying rollers 12*c* and 12*d* passes through the registration rollers 13, the secondary transfer roller 10 and the fixing unit 7 so that the printing on a back surface is performed, and discharged to the paper discharge unit 91.

Furthermore, as shown in FIG. 2, the image forming apparatus 100 includes an apparatus control section 21, a storage section 22, and a calculation section 23. The apparatus control section 21 controls image forming operation in the image forming apparatus 100 in an integrated manner.

In the storage section 22, printing command through an operation panel (display portion 24, input portion 25) arranged on an upper surface of the image forming apparatus 100, detection results from various sensors arranged in each of places inside the image forming apparatus 100, image information input through a USB/LAN 26 from an external device, various setting values and data tables for controlling operation of each of units inside the image forming apparatus 100, programs for executing various controls and the like are able to be stored. As the storage section 22, one commonly used in this field is usable including a read-only memory (ROM), random access memory (RAM), a hard disk drive (HDD), etc. As the external device, an electric and electronic device which is capable of forming or obtaining image information and electrically connectable to the image forming apparatus 100 is usable including a computer, a digital camera, etc.

The calculation section 23 takes out various data stored in the storage section 22 (printing command, detection result, image information, etc.) and a program for implementing various control, and performs various detection and/or determination. The apparatus control section 21 transmits a control signal to a corresponding unit corresponding to various determination results or calculation results in the calculation section 23 so that operation control is performed.

The apparatus control section 21 and the calculation section 23 are a processing circuit realized by a microcomputer including a central processing unit (CPU) or a microprocessor, for example.

Further, the image forming apparatus 100 is a multi-functional peripheral including, for example, a scanner, a printer, and a peripheral device, and provided with a reading portion 27 which reads a document image, an image processing portion 28 which generates image data by converting the read document image into an appropriate electric signal, the above-described image forming portion P which visualizes the generated image data with using a toner to form an image on recording paper, and a peripheral device control portion 29 which controls a peripheral device such as a finisher or a sorter which is a post processing device.

(Charging Device)

Figure 3:
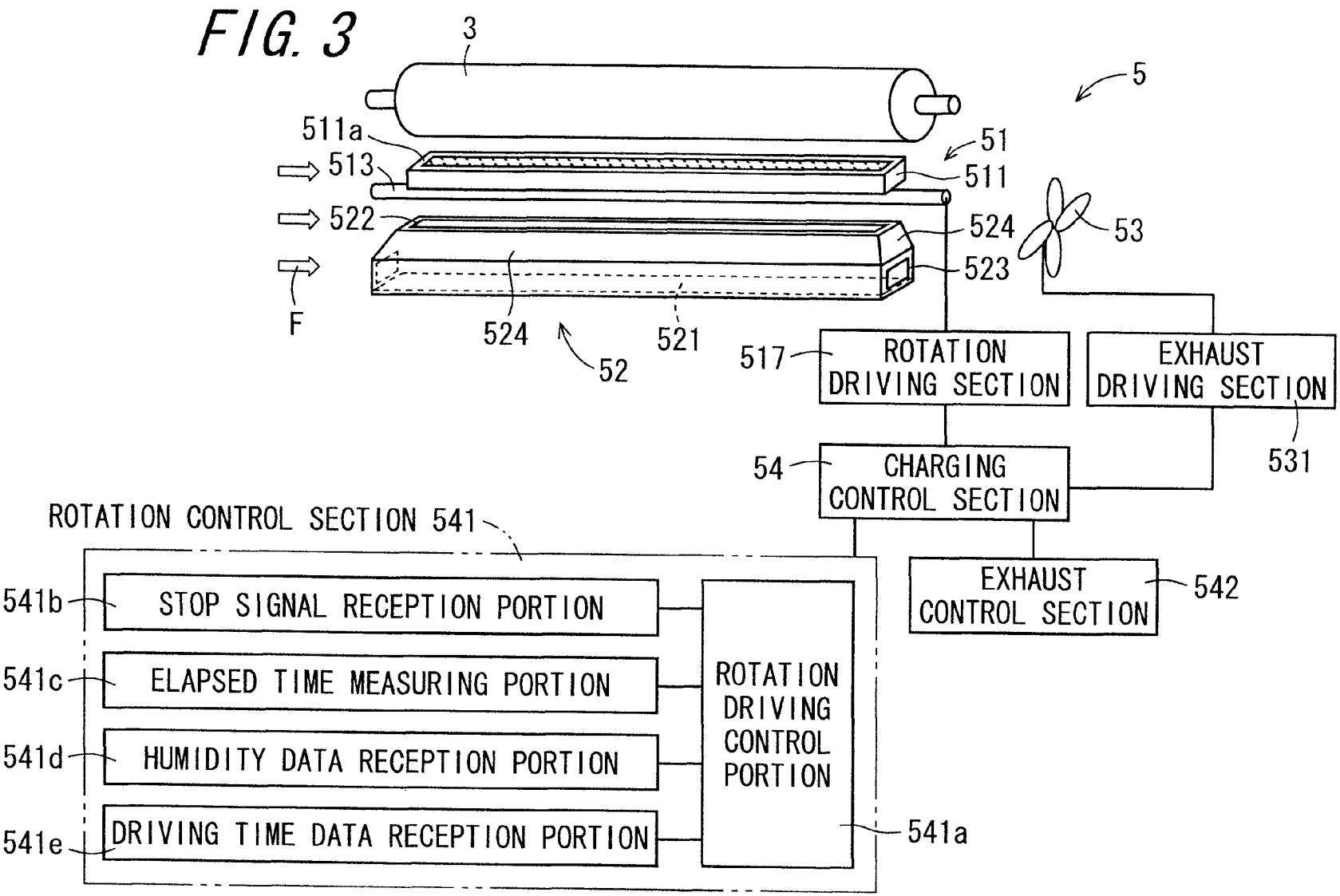
FIG. 3 is a perspective view showing a configuration of a charging device according to an embodiment of the invention.
Figure 4:
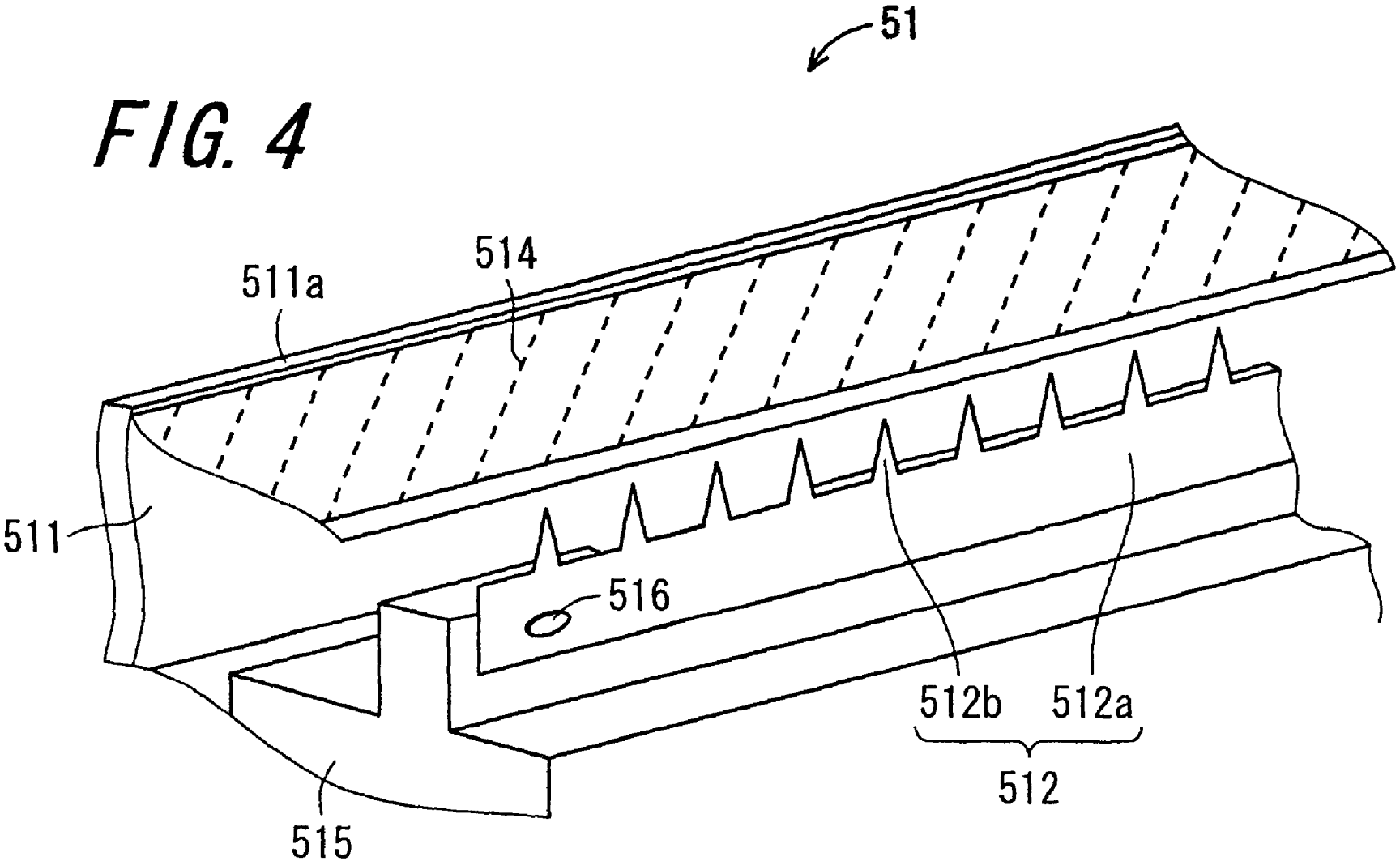
FIG. 4 is a perspective view showing a configuration of a charging section.

FIG. 3 is a perspective view showing a configuration of a charging device 5 according to an embodiment of the invention. Further, FIG. 4 is a perspective view showing a configuration of a charging section 51. The charging device 5 is a device for charging the surface of the photoreceptor 3 uniformly to predetermined potential, and includes a charging section 51 which charges the surface of a photoreceptor 3, a discharge product adsorption removal section 52, an exhaust section 53, and a charging control section 54.

The charging section 51 includes a plate-like discharge electrode 512 having a plurality of sharp-pointed protrusion portions 512*b*, a holding member 515 which holds the discharge electrode 512, a shield case 511 which contains the discharge electrode 512 and the holding member 515, a grid electrode 514 which adjusts charging potential on the surface of the photoreceptor 3, and a rotation shaft 513. The charging section 51 is an element in which a corona discharge is generated by applying voltage to the discharge electrode 512 so that the surface of the photoreceptor 3 is charged as well as the charged state on the surface of the photoreceptor 3 is uniformed by applying predetermined grid voltage to the grid electrode 514, and thereby the surface of the photoreceptor 3 is charged to predetermined potential and a polarity. The charging section 51 is arranged along the axial direction of the photoreceptor 3 as facing the photoreceptor 3.

The discharge electrode 512 is a member which is provided in parallel with a longitudinal axis parallel to the rotation axis of the of photoreceptor 3, and which charges the surface of the photoreceptor 3 by generating a corona discharge by applying voltage of a several kV. In the embodiment, the discharge electrode 512 is a thin plate-like member and configured by a flat plate portion 512*a* extending in the axial direction of the photoreceptor 3, and sharp-pointed protrusion portions 512*b* which are formed to protrude from one end surface of a short side direction (a direction perpendicular to the axial direction of the photoreceptor 3) of the flat plate portion 512*a* into the short-side direction. As a material constituting the discharge electrode 512, one capable of generating a corona discharge by applying voltage thereto, and capable of forming the sharp-pointed protrusion portions 512*b* is able to be used without particular limitation, and, for example, examples thereof include stainless steel, aluminum, nickel, copper and iron. Among them, stainless steel is preferable.

The holding member 515 which holds the discharge electrode 512 is a member extending in the axial direction of the photoreceptor 3 similarly to the discharge electrode 512, and whose section orthogonal to the extending direction is an inverted T shape, and made of resin, for example. The discharge electrode 512 is screwed into around both end parts of the extending direction (longitudinal axis) thereof by a screw member 516 on one side surface of the protruding part of the holding member 515.

The grid electrode 514 is disposed between the discharge electrode 512 and the photoreceptor 3 so as to fit into a shield opening 511*a* of the shield case 511. The grid electrode 514 is composed of a metal material which is the same as that of the discharge electrode 512 and formed into a plate shape having a plurality of through holes. Moreover, to the grid electrode 514, a high voltage power source having a high voltage transformer (TH) (output voltage: −650 V) and a low voltage power source having a low voltage transformer (TL) (output voltage: −250 V) are connected through a changing switch. Then, by operating the changing switch, the grid voltage in which the high voltage and the low voltage alternately appear is applied to the grid electrode 514, and variation in the charging state on the surface of the photoreceptor 3 is adjusted to uniform the charging potential.

The shield case 511 extends along the longitudinal axis parallel to the rotation axis of the photoreceptor 3 and has a shield opening 511*a* which faces and opens one direction perpendicular to the longitudinal axis. In the embodiment, the shield case 511 is made of stainless steel, for example, and is a case shaped member whose external shape is a rectangular parallelepiped having an inner space and having a shield opening 511*a* on one surface facing the photoreceptor 3 (upper surface). The shield case 511 extends in the same direction as the discharge electrode 512 and on a bottom surface thereof, a holding member 515 is attached. Then, in charging operation of charging the surface of the photoreceptor 3 by the charging section 51, the shield opening 511*a* of the shield case 511 is to oppose to the photoreceptor 3 with a predetermined gap therebetween.

The rotation shaft 513 is disposed to be rotatable about an axial line parallel to the rotation axis of the photoreceptor 3, and to which the shield case 511 is fixed. That is, the rotation shaft 513 is disposed so as to be fixed on an outer surface of a bottom plate opposing to the shield opening 511*a* in the shield case 511, and extends in parallel with the rotation axis of the photoreceptor 3. Then, the rotation shaft 513 is rotatable from a position where the shield opening 511*a* opposes to the photoreceptor 3 to a position where the shield opening 511*a* faces the discharge product adsorption removal section 52.

The charging section 51 configured as hereinbefore is disposed to be rotatable about the axis of the rotation shaft 513 so that the shield opening 511*a* of the shield case 511 is displaceable from a position opposing to the photoreceptor 3 to a position opposing to the discharge product adsorption removal section 52, which will be described later.

The discharge product adsorption removal section 52 is disposed on the downward side in the vertical direction of the photoreceptor 3, and has an adsorption layer 521 composed of an adsorbent that adsorbs a discharge product such as nitrogen oxide generated in charging the surface of the photoreceptor 3 by the charging section 51.

As long as the discharge product adsorption removal section 52 has the adsorption layer 521, a shape thereof is not particularly limited, however, in the embodiment, it is formed into a case shape extending along the rotation axis of the photoreceptor 3. On an upper surface of the discharge product adsorption removal section 52 which is formed into a case shape, an adsorption opening 522 extending along the rotation axis of the photoreceptor 3 to open is formed, and on a bottom surface opposing to the upper surface, the adsorption layer 521 is formed. Furthermore, on both ends in the longitudinal axis which is parallel to the rotation axis of the photoreceptor 3 in the discharge product adsorption removal section 52, airflow passage openings 523 which are openings where airflow generated by the exhaust section 53, which will be described later, passes through is formed. Furthermore, in the discharge product adsorption removal section 52, on a side surface which continues from the upper surface to the bottom surface, an inclined surface 524 inclining toward outer side from a marginal part of the adsorption opening 522 to the bottom surface, is formed.

The adsorption layer 521 is a layer composed of an adsorbent that adsorbs a discharge product such as nitrogen oxide. As the adsorbent constituting the adsorption layer 521, zeolite, a silica-alumina type adsorbent, silica gel, alumina gel, activated alumina, and the like are able to be included, however, zeolite is preferable.

Since zeolite is a material excellent in adsorption performance to the discharge product such as such as nitrogen oxide, it enables to improve the efficiency of adsorbing and removing the discharge product by the discharge product adsorption removal section 52. Zeolite has a structure of a three-dimensional network in which $TO_4$ tetrahedrons (T=Si, Al) share an oxygen (O) atom which is at a top thereof, and is an aluminosilicate based crystalline material containing zeolite water capable of desorbing without breaking the configuration and exchangeable cation, and has micropores in the crystalline.

Furthermore, as a method of forming the adsorption layer 521 composed of zeolite on a bottom surface of the discharge product adsorption removal section 52 which is formed into a case shape, following two methods are able to be included. In a first method, by using mixed aqueous solution of silica-alumina gel and tetrapropylammonium salt, crystals are precipitated at a high ph region under a hydrothermal condition of 100 to 200° C., and thereby the adsorption layer 521 is able to be formed. In a second method, the adsorption layer 521 is able to be formed with a coating method using paste-like dispersion liquid which zeolite particles are dispersed into triethylene glycol (TEG).

Furthermore, a range of a preferred thickness of the adsorption layer 521 composed of zeolite is set based on evaluation results shown below.

<Evaluation of Image Defection of White Voids>

Ten kinds of discharge product adsorption removal sections each of which adsorption layer had a different film-thickness were produced and each discharge product adsorption removal section was mounted on an image forming apparatus. Image forming operation for recording paper in such an image forming apparatus was performed for 3000 sheets in one month under environmental conditions of temperature of 25° C. and humidity of 5%.

Thereafter, further image forming operation for recording paper of 50 sheets was performed, left for an hour, and recording paper obtained after executing the next image forming operation was used and occurring state of image defection of white voids in pitches of a circumferential length of a photoreceptor in a halftone image was visually evaluated. Evaluation standards are shown as follows.

Excellent: No occurrence of image defection of white voids.

Good: Although there is an occurrence of image defection of streaky white voids, a width thereof is 10 mm or less.

Not bad: There is an occurrence of image defection of streaky white voids, and a width thereof exceeds 10 mm and 20 mm or less.

Poor: There is an occurrence of image defection of streaky white voids, and a width thereof exceeds 20 mm.

<Evaluation of Image Defection of Image Deletion>

Ten kinds of discharge product adsorption removal sections each of which adsorption layer had a different film-thickness were produced and each discharge product adsorption removal section was mounted on an image forming apparatus. Image forming operation for recording paper in such an image forming apparatus was performed for 3000 sheets in one month under environmental conditions of temperature of 35° C. and humidity of 85%.

Thereafter, further image forming operation for recording paper of 50 sheets was performed, left for an hour, and recording paper obtained after executing the next image forming operation was used and occurring state of a blur of a character in a character image was visually evaluated, and which was regarded as evaluations of image defection of image deletion. Evaluation standards are shown as follows.

Excellent: No occurrence of a blur of a character in a character image.

Good: Slight occurrence of a blur of a character in a character image.

Not bad: Although occurrence of a blur of a character in a character image is remarkable, recognition of a character is sufficiently possible.

Poor: Occurrence of a blur of a character to a state of being impossible to recognize a character.

<Evaluation Results>

The evaluation results of the image defection of white voids and the image defection of image deletion in image forming apparatuses on which 10 kinds of discharge product adsorption removal sections each of which adsorption layer has a different film-thickness are mounted respectively are shown in table 1.

TABLE 1

| Discharge product adsorption removal section Film-thickness of adsorption layer (μm) | Evaluation results: Evaluation of image defection of white voids | Evaluation results: Evaluation of image defection of image deletion |
|---|---|---|
| 30 | Not bad | Not bad |
| 40 | Good | Good |
| 50 | Excellent | Excellent |
| 60 | Excellent | Excellent |
| 70 | Excellent | Excellent |
| 80 | Excellent | Excellent |
| 90 | Excellent | Excellent |
| 100 | Excellent | Excellent |
| 150 | Excellent | Excellent |
| 0 (No adsorption layer) | Poor | Poor |

As evident from the table 1, in the image forming apparatus provided with the discharge product adsorption removal section in which the adsorption layer composed of zeolite is formed, a discharge product is adsorbed and removed by the adsorption layer, and thereby occurrence of the image defection such as white voids and image deletion is able to be suppressed.

Based on the evaluation results in the table 1, the thickness of the adsorption layer 521 composed of zeolite is preferable to be 40 to 100 μm, and further preferable to be 50 to 100 μm. Thereby the ability to adsorb and remove the discharge product by the discharge product adsorption removal section 52 is maintained over a long term. Note that, as the thickness of the adsorption layer 521 becomes thicker, the ability to adsorb and remove the discharge product is maintained over a long term, however, when a cost problem is considered, the thickness is preferable to be 100 μm or less.

The charging device 5 of the embodiment further includes an exhaust section 53. The exhaust section 53 is a section to generate airflow which flows in a direction F directed from one end to another end in the rotation axis of the photoreceptor 3. In the embodiment, the exhaust section 53 is an exhaust fan that generates airflow by rotation thereof.

In the charging device 5 including the charging section 51, the discharge product adsorption removal section 52 and the exhaust section 53 hereinabove, the discharge product adsorption removal section 52 is disposed on the downward side in the vertical direction of the photoreceptor 3.

Since molar weight of nitrogen monoxide (NO) is 30.0 g/mol, molar weight of nitrogen dioxide ($NO_2$) is 46.0 g/mol, and molar weight of air is 28.9 g/mol, the discharge product such as nitrogen oxide composed of the nitrogen monoxide and the nitrogen dioxide is heavier than air. Therefore, the discharge product generated in charging the surface of the photoreceptor 3 by the charging section 51 flows downward in the vertical direction along the surface of the photoreceptor 3.

Contrary to this, in the charging device 5 of the embodiment, since the discharge product adsorption removal section 52 having the adsorption layer 521 of adsorbing the discharge product is disposed on the downward side in the vertical direction of the photoreceptor 3, a discharge product floated in the air in the vicinity of the photoreceptor 3 and flowing downward in the vertical direction along the surface of the photoreceptor 3 are able to be adsorbed and removed efficiently. Thereby, the charging device 5 is capable of preventing occurrence of the image defection such as white voids or image deletion caused by the discharge product.

Further, in the charging device 5 with the configuration in which the discharge electrode 512 is disposed inside the shield case 511, the discharge product is retained at high concentrations in an inner space of the shield case 511 after discharge operation by the discharge electrode 512. Therefore, in the charging device 5 of the embodiment, the charging section 51 is disposed to be rotatable about the axial line of the rotation shaft 513 so that the shield opening 511*a* of the shield case 511 is displaceable from a position opposing to the photoreceptor 3 to the position opposing to the discharge product adsorption removal section 52.

In the charging device 5, when the charging section 51 is displaced so that the shield opening 511*a* opposes to the photoreceptor 3, the surface of the photoreceptor 3 is able to be charged, and when the charging section 51 is displaced so that the shield opening 511*a* opposes to the discharge product adsorption removal section 52, the discharge product retained in the inner space of the shield case 511 is able to be removed efficiently. Therefore, the charging device 5 is capable of adsorbing and removing the discharge product retained in the inner space of the shield case 511 without degrading charging performance, and capable of preventing occurrence of image defection such as white voids or image deletion caused by the discharge product.

Further, the charging device 5 of the embodiment further includes an exhaust section 53 which generates airflow flowing from one end to another end in the rotation axis of the photoreceptor 3. Then, the discharge product adsorption removal section 52 extends along the rotation axis of the photoreceptor 3 and formed into a case shape. In the charging device 5 configured in such a manner, airflow generated by the exhaust section 53 passes through the airflow passage openings 523 in the discharge product adsorption removal section 52 and thereby flows downward in the vertical direction along the surface of the photoreceptor 3, and the discharge product proceeded into the inner space of the discharge product adsorption removal section 52 formed into a case shape is guided by the airflow to be in contact with the adsorption layer 521 which is formed on the bottom surface of the discharge product adsorption removal section 52. Thereby the efficiency of adsorbing and removing the discharge product by the discharge product adsorption removal section 52 is able to be improved.

Further, the airflow generated by the exhaust section 53 passes through the airflow passage openings 523 in the discharge product adsorption removal section 52 even in the case where the charging section 51 is displaced so that the shield opening 511*a* opposes to the adsorption opening 522 of the discharge product adsorption removal section 52, and thereby the discharge product retained in the inner space of the shield case 511 is guided by the airflow to be in contact with the adsorption layer 521 formed on the bottom surface of the discharge product adsorption removal section 52. Thereby, the efficiency of adsorbing and removing the discharge product retained in the inner space of the shield case 511 by the discharge product adsorption removal section 52 is able to be improved.

Figure 5A:
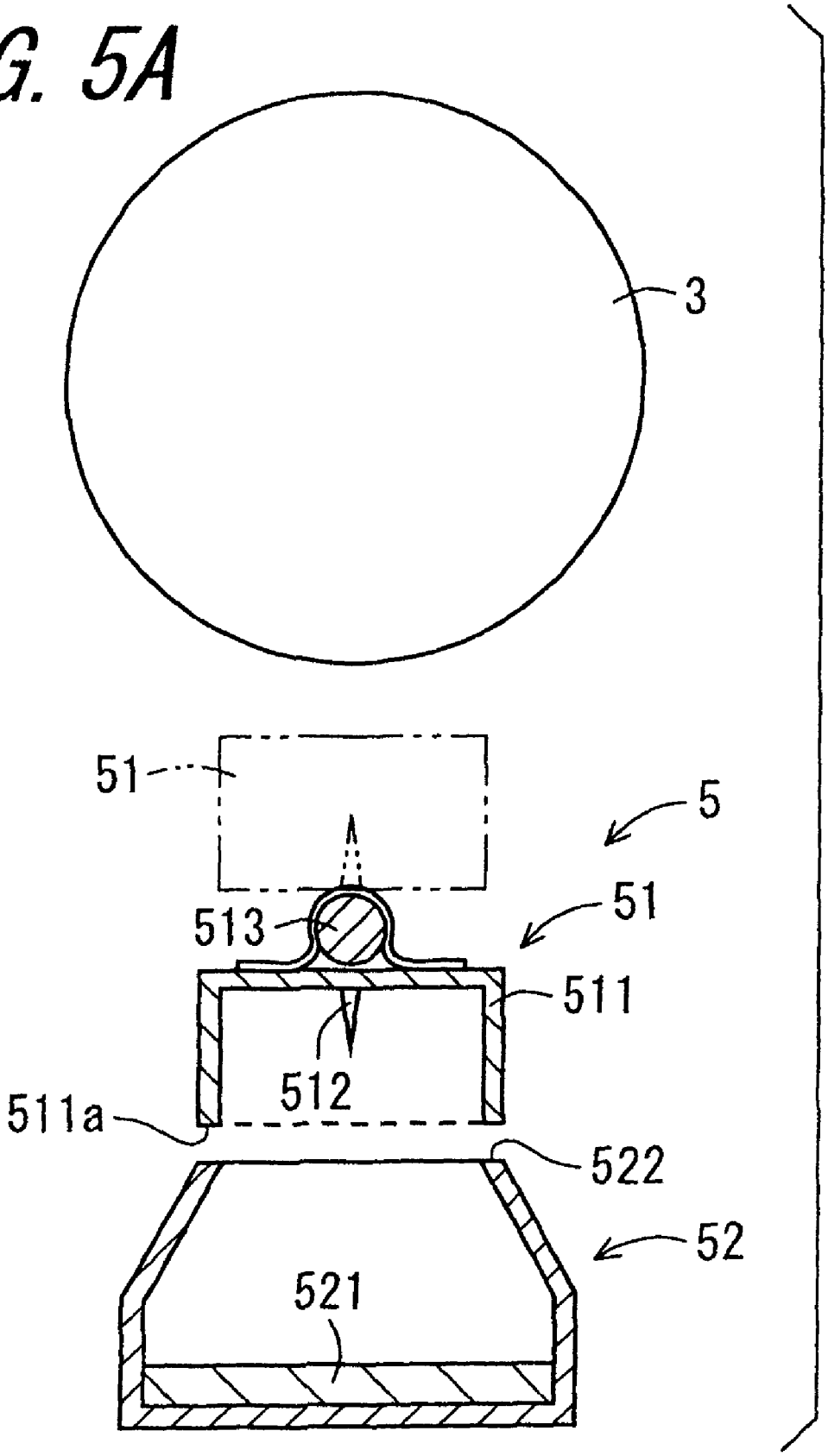
FIGS. 5A and 5B are drawings showing a relation between an arranged position of the discharge product adsorption removal section and a rotation driving operation of the charging section.
Figure 5B:
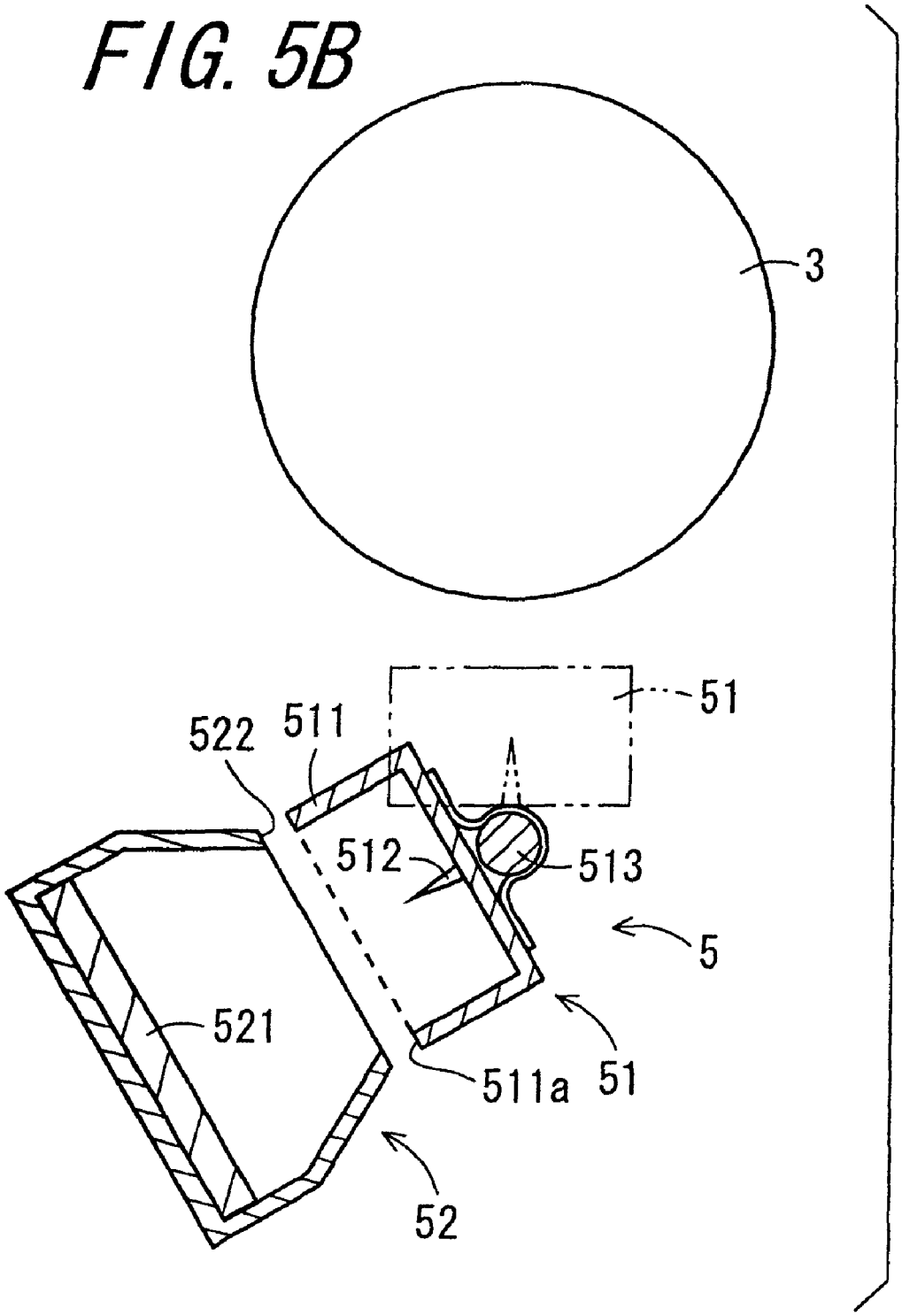

FIGS. 5A and 5B are drawings showing a relation between an arranged position of the discharge product adsorption removal section 52 and a rotation driving operation of the charging section 51.

In the charging device 5, it is preferable that the charging section 51 and the discharge product adsorption removal section 52 are arranged side by side in this order downward in the vertical direction of the photoreceptor 3. In the charging device 5 configured in this manner, the charging section 51 is rotated by 180° around the axis of the rotation shaft 513, and thereby the shield opening 511*a* of the shield case 511 is displaced from a position opposing to the photoreceptor 3 to a position opposing to the adsorption opening 522 of the discharge product adsorption removal section 52. In such a charging device 5, the discharge product adsorption removal section 52 is arranged downward in the vertical direction of the photoreceptor 3 and thereby it is possible to improve the efficiency of adsorbing and removing the discharge product floated in the air in the vicinity of the photoreceptor 3 and flowing downward in the vertical direction along the surface of the photoreceptor 3 and the discharge product retained in the inner space of the shield case 511 by the discharge product adsorption removal section 52.

Further, in the charging device 5, a rotation angle θ may be set in a range of $90° < \theta < 270°$ when the charging section 51 is arranged downward in a vertical direction of the photoreceptor 3, and the shield opening 511*a* rotates from the position opposing to the photoreceptor 3 to the position opposing to the adsorption opening 522 of the discharge product adsorption removal section 52. For example, when the rotation angle θ of the charging section 51 is set to 135°, as shown in FIG. 5B, the opening surface of the adsorption opening 522 of the discharge product adsorption removal section 52 is a surface being not parallel but having an inclination of 45° to the vertical direction. The charging device 5 is thereby able to prevent degradation in efficiency of adsorbing and removing, by the discharge product adsorption removal section 52, a discharge product floated in the air in the vicinity of the photoreceptor 3 and flowing downward in a vertical direction along a surface of the photoreceptor 3 and the discharge product retained in an inner space of the shield case 511.

FIGS. 6A to 6D are drawings explaining displacement operation of the charging section 51. The charging device 5 of the embodiment is configured such that the charging section 51 is rotationally driven around the axis of the rotation shaft 513, therefore it is necessary to secure a rotation space of the charging section 51 so that the charging section 51 is rotatable without contacting the photoreceptor 3 and the discharge product adsorption removal section 52.

When the rotation space of the charging section 51 is secured, there is a possibility that a gap between the charging section 51 and the photoreceptor 3, and a gap between the charging section 51 and the discharge product adsorption removal section 52 become excessively large. When the gap between the charging section 51 and the photoreceptor 3 becomes excessively large, there is a possibility that charging performance by the charging section 51 for the photoreceptor 3 is degraded, and when the gap between the charging section 51 and the discharge product adsorption removal section 52 becomes excessively large, there is a possibility that adsorption removal efficiency of the discharge product retained in the inner space of the shield case 511 by the discharge product adsorption removal section 52 is degraded.

Figure 6A:
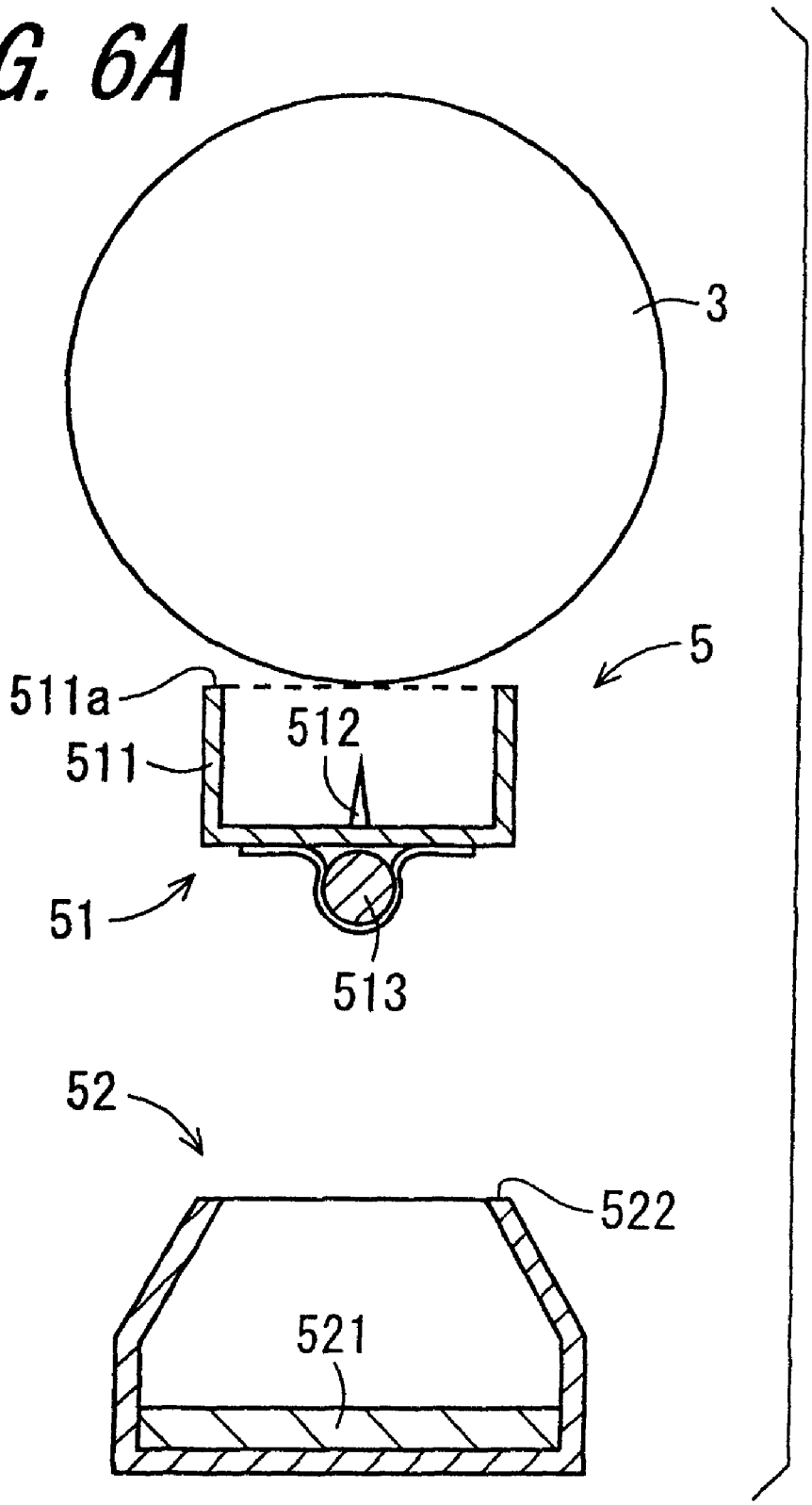
FIGS. 6A to 6D are drawings explaining displacement operation of the charging section.
Figure 6B:
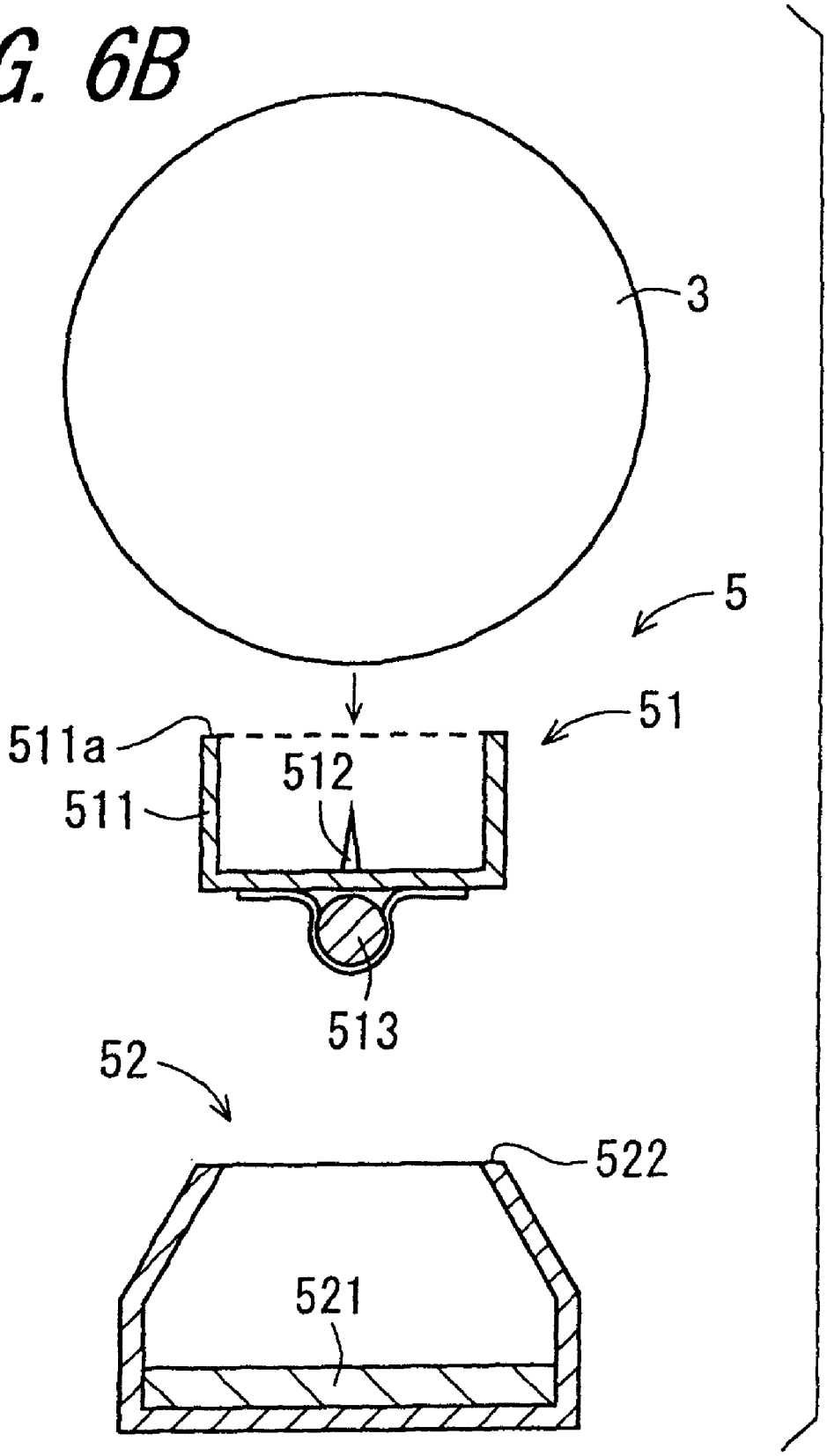
Figure 6C:
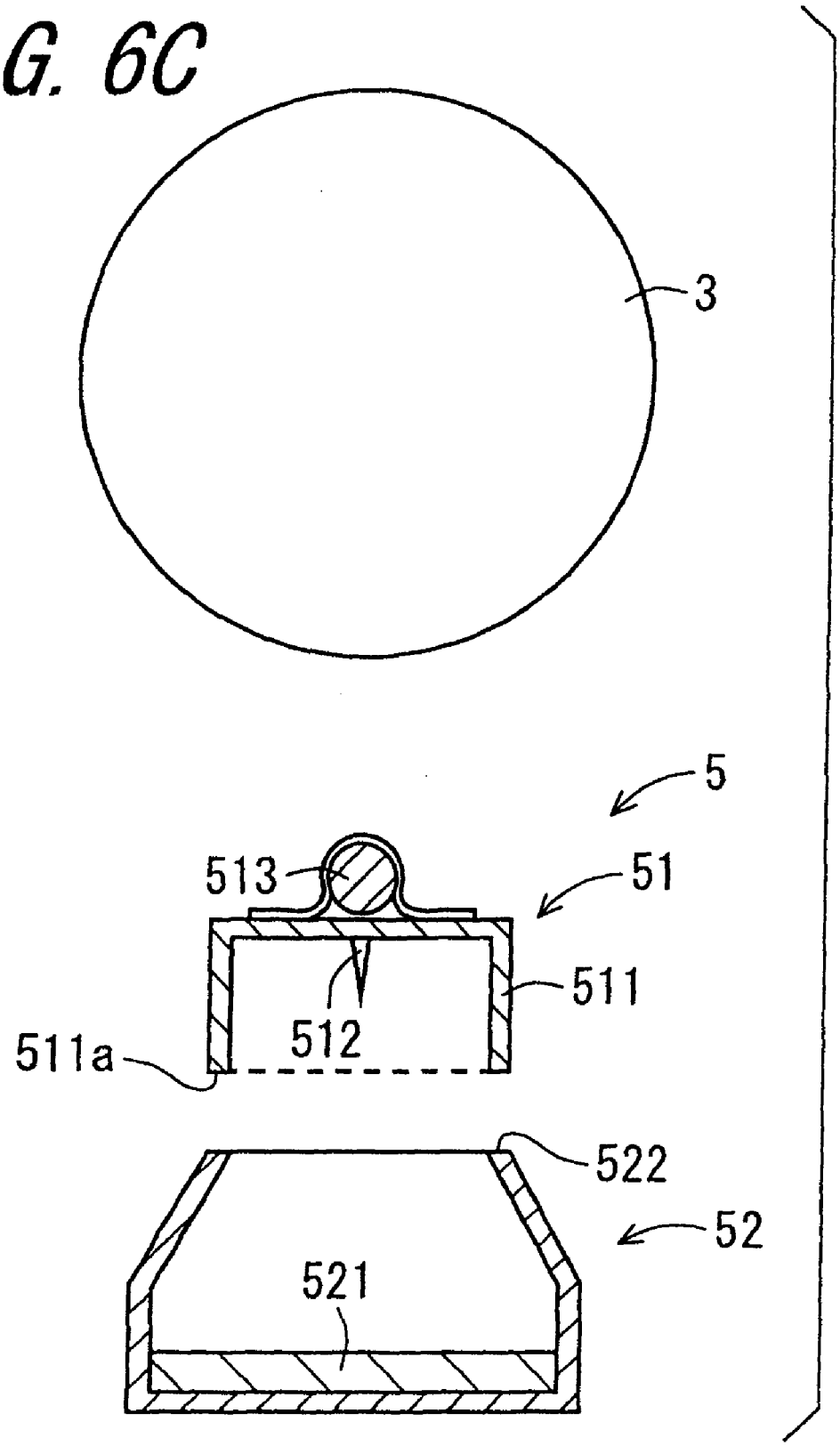
Figure 6D:
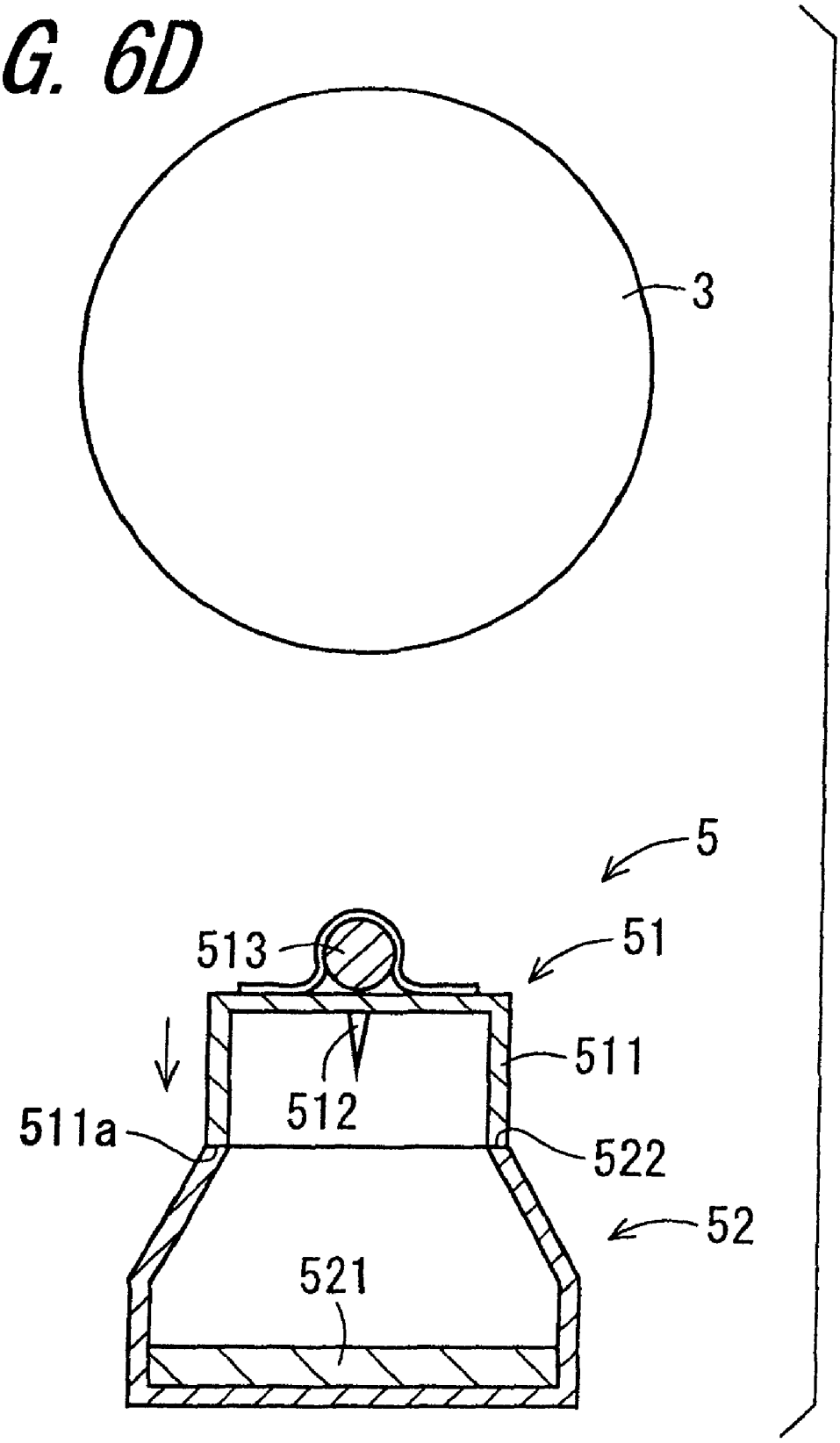

Therefore, the charging section 51 may be configured so as to perform displacement operation combining rotation driving operation and parallel movement operation as shown in FIGS. 6A to 6D. When the charging section 51 charges the surface of the photoreceptor 3, as shown in FIG. 6A, the charging section 51 is arranged opposing to the photoreceptor 3 so that the gap between the charging section 51 and the photoreceptor 3 is the gap with which desired charging performance is able to be obtained. Next, when the charging operation of the charging section 51 is finished, and the discharge product retained in the inner space of the shield case 511 is adsorbed and removed by the discharge product adsorption removal section 52, first, as shown in FIG. 6B, the charging section 51 is subjected to a parallel movement downward in the vertical direction, and the rotation space of the charging section 51 is secured. Next, as shown in FIG. 6C, the charging section 51 is rotationally driven around the axis of a rotation shaft 513 so that the shield opening 511*a* is displaced from the position opposing to the photoreceptor 3 to the position opposing to the adsorption opening 522 of the discharge product adsorption removal section 52. Then, as shown in FIG. 6D, the charging section 51 is subjected to a parallel movement in a direction going close to the discharge product adsorption removal section 52 until the shield opening 511*a* contacts the adsorption opening 522 of the discharge product adsorption removal section 52. The charging device 5 is thereby able to sufficiently remove the discharge product retained in the inner space of the shield case 511 without degrading the charging performance.

When operation to adsorb and remove the discharge product in the shield case 511 by the discharge product adsorption removal section 52 is finished, the charging section 51 is subjected to a parallel movement upward in the vertical direction and the rotation space of the charging section 51 is secured. Next, the charging section 51 is rotationally driven around the axis of the rotation shaft 513 so that the shield opening 511*a* is displaced from the position opposing to the adsorption opening 522 to the position opposing to the photoreceptor 3. Then, the charging section 51 is subjected to a parallel movement in the direction going close to the photoreceptor 3 until the gap between the charging section 51 and the photoreceptor 3 becomes the gap with which desired charging performance is able to be obtained.

Returning to FIG. 3, the charging device 5 of the embodiment includes the charging control section 54. The charging control section 54 is controlled by the apparatus control section 21 provided in the image forming apparatus 100, and includes a rotation control section 541 and an exhaust control section 542. The exhaust control section 542 is controlled by the charging control section 54, and controls exhaust operation of the exhaust section 53 by an exhaust driving section 531.

The rotation control section 541 is controlled by the charging control section 54, and controls rotation driving operation about the axial line of the rotation shaft 513 in the charging section 51. The rotation control section 541 includes a rotation driving control portion 541*a*, a stop signal reception portion 541*b*, an elapsed time measuring portion 541*c*, a humidity data reception portion 541*d*, and a driving time data reception portion 541*e*.

The rotation driving control portion 541*a* controls the rotation driving operation of the charging section 51 based on information from the stop signal reception portion 541*b*, the elapsed time measuring portion 541*c*, the humidity data reception portion 541*d*, and the driving time data reception portion 541*e*. The stop signal reception portion 541*b* receives a photoreceptor stop signal from the apparatus control section 21, the photoreceptor stop signal being a signal that is generated by inputting a command to cut off a power source of the image forming apparatus 100 to the input portion 25 of the operation panel of the image forming apparatus 100, and that indicates an instruction to stop the rotation driving operation of the photoreceptor 3.

The elapsed time measuring portion 541*c* measures an elapsed time since the charging section 51 is rotationally driven by a rotation driving section 517 and the shield opening 511*a* is maintained at the position opposing to the adsorption opening 522. The humidity data reception portion 541*d* receives humidity data detected by a humidity sensor installed in the vicinity of the charging section 51 from the apparatus control section 21. The driving time data reception portion 541*e* receives driving time data indicating a photoreceptor driving time that the photoreceptor 3 is rotationally driven from the apparatus control section 21. The driving time data received by the driving time data reception portion 541*e* includes, for example, data indicating in percentage a rate of time that the photoreceptor 3 had been rotationally driven in 15 minutes extended back from when the stop signal reception portion 541*b* received the photoreceptor stop signal.

Figure 7:
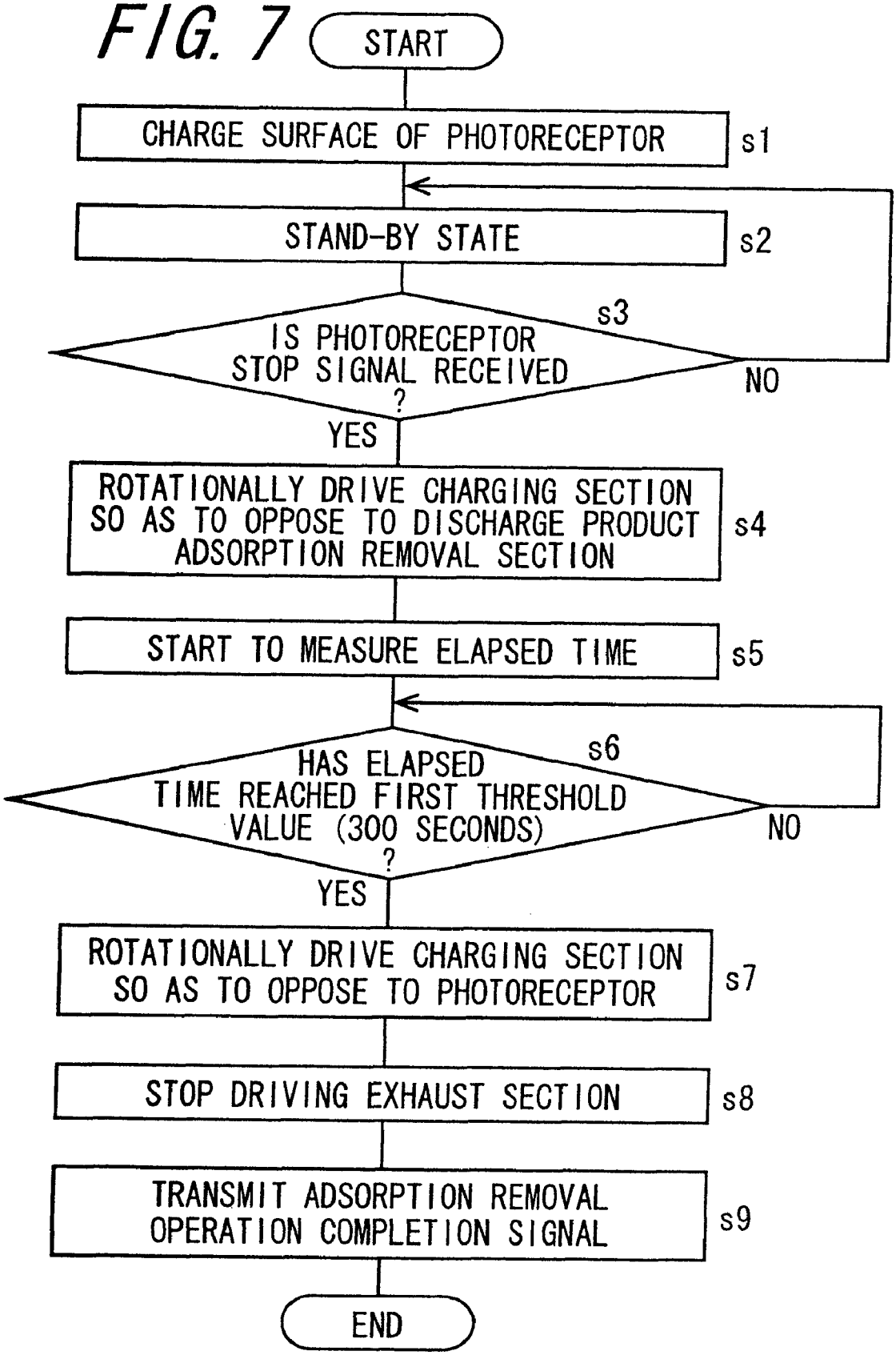
FIG. 7 is a flowchart showing a first example of a flow of operation of the charging device.

FIG. 7 is a flowchart showing a first example of a flow of operation of the charging device 5. At step s1, the charging device 5 charges the surface of the photoreceptor 3 in a state where the shield opening 511*a* of the charging section 51 is maintained at the position opposing to the photoreceptor 3. At this time, the exhaust control section 542 controls the exhaust driving section 531, and causes the exhaust section 53 to continue the exhaust operation to generate airflow.

Next, at step s2, in accordance with a situation that the image forming operation at the image forming apparatus 100 is stopped to be in a stand-by state, the charging device 5 is in a stand-by state with the charging operation for the photoreceptor 3 stopped.

Next, at step s3, the rotation driving control portion 541*a* judges whether or not the stop signal reception portion 541*b* has received the photoreceptor stop signal. When it is judged that the stop signal reception portion 541*b* has received the photoreceptor stop signal, the procedure proceeds to step s4, and when it is judged that the photoreceptor stop signal has not been received, the procedure returns to step s2 to continue the stand-by state.

At step s4, the rotation driving control portion 541*a* rotationally drives the charging section 51 so that the shield opening 511*a* of the charging section 51 is displaced from the position opposing to the photoreceptor 3 to the position opposing to the adsorption opening 522. The charging device 5 is thereby able to efficiently adsorb and remove the discharge product retained in the inner space of the shield case 511 by the discharge product adsorption removal section 52.

At step s5, the elapsed time measuring portion 541*c* starts to measure the elapsed time since the shield opening 511*a* is maintained at the position opposing to the adsorption opening 522. Then, at step s6, the rotation driving control portion 541*a* judges whether or not the elapsed time measured by the elapsed time measuring portion 541*c* has reached a first threshold value (for example, 300 seconds). When the elapsed time is judged to have reached the first threshold value, the procedure proceeds to step s7, and when the elapsed time is judged not to have reached the first threshold value, step s6 is repeated.

At step s7, the rotation driving control portion 541*a* rotationally drives the charging section 51 so that the shield opening 511*a* of the charging section 51 is displaced from the position opposing to the adsorption opening 522 to the position opposing to the photoreceptor 3. The charging device 5 is thereby able to prepare so that the charging operation to charge the surface of the photoreceptor 3 is performed smoothly.

Next, at step s8, the exhaust control section 542 controls the exhaust driving section 531, and causes the exhaust section 53 to stop the exhaust operation to generate airflow. Then, at step s9, the charging control section 54 transmits adsorption removal operation completion signal indicating that the adsorption removal operation by the discharge product adsorption removal section 52 is completed to the apparatus control section 21. The apparatus control section 21 that has received the adsorption removal operation completion signal completely cuts off the power source of the image forming apparatus 100.

Figure 8:
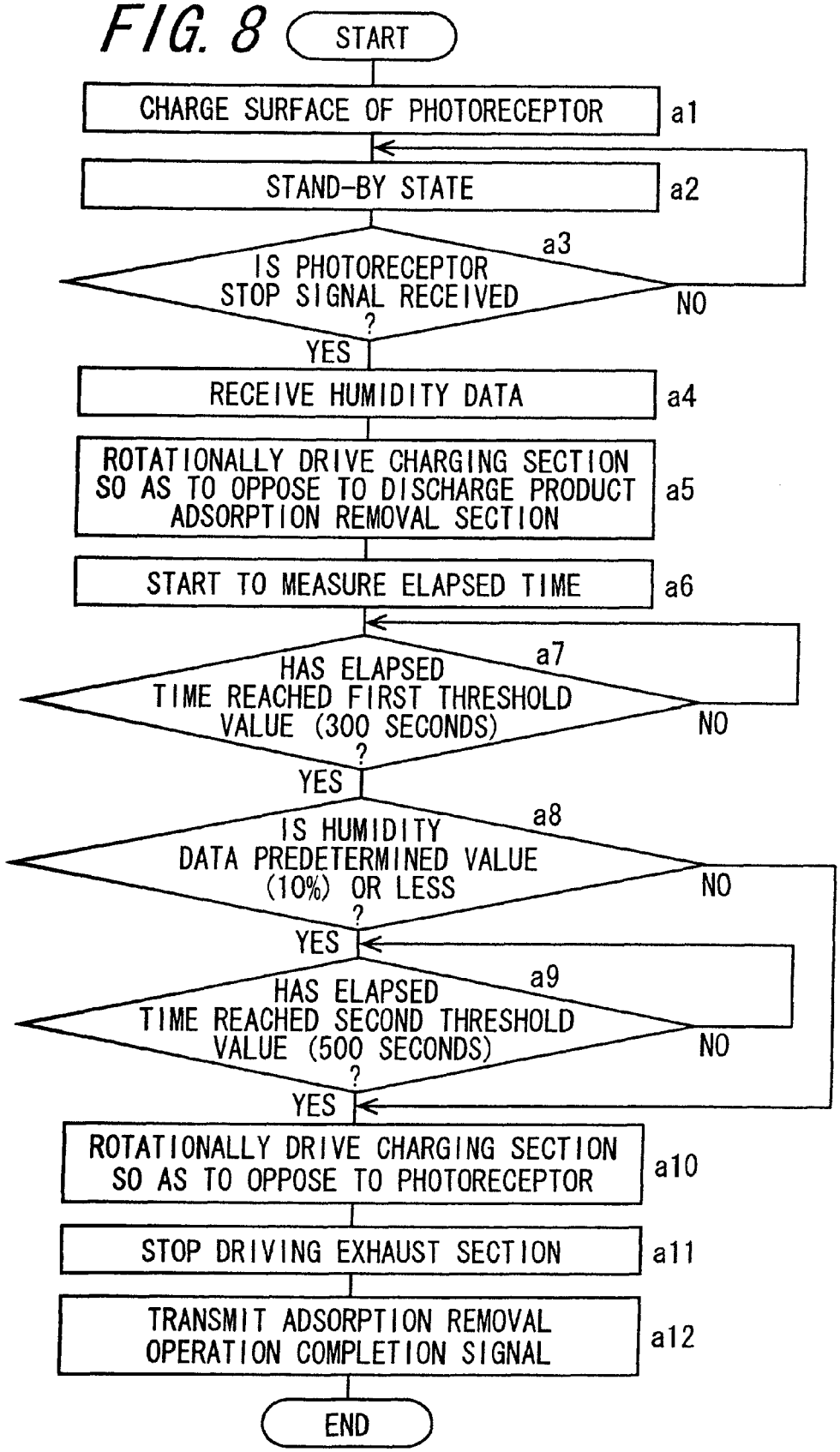
FIG. 8 is a flowchart showing a second example of the flow of the operation of the charging device.

FIG. 8 is a flowchart showing a second example of the flow of the operation of the charging device 5. The generation amount of the discharge product generated in charging the surface of the photoreceptor 3 by the charging section 51 varies depending on the humidity condition in the vicinity of the charging section 51, and along with decrease of humidity, the generation amount of the discharge product increases. Thus, it is preferable to control the adsorption removal operation of the discharge product by the discharge product adsorption removal section 52 depending on the humidity condition in the vicinity of the charging section 51.

At step a1, the charging device 5 charges the surface of the photoreceptor 3 in the state where the shield opening 511*a* of the charging section 51 is maintained at the position opposing to the photoreceptor 3. At this time, the exhaust control section 542 controls the exhaust driving section 531, and causes the exhaust section 53 to continue the exhaust operation to generate airflow.

Next, at step a2, in accordance with a situation that the image forming operation at the image forming apparatus 100 is stopped to be in the stand-by state, the charging device 5 is in the stand-by state with the charging operation for the photoreceptor 3 stopped.

Next, at step a3, the rotation driving control portion 541*a* judges whether or not the stop signal reception portion 541*b* has received the photoreceptor stop signal. When it is judged that the stop signal reception portion 541*b* has received the photoreceptor stop signal, the procedure proceeds to step a4, and when it is judged that the photoreceptor stop signal has not been received, the procedure returns to step a2 to continue the stand-by state.

At step a4, the humidity data reception portion 541*d* receives humidity data. Then, at step a5, the rotation driving control portion 541*a* rotationally drives the charging section 51 so that the shield opening 511*a* of the charging section 51 is displaced from the position opposing to the photoreceptor 3 to the position opposing to the adsorption opening 522. The charging device 5 is thereby able to efficiently adsorb and remove the discharge product retained in the inner space of the shield case 511 by the discharge product adsorption removal section 52.

At step a6, the elapsed time measuring portion 541*c* starts to measure the elapsed time since the shield opening 511*a* is maintained at the position opposing to the adsorption opening 522. Then, at step a7, the rotation driving control portion 541*a* judges whether or not the elapsed time measured by the elapsed time measuring portion 541*c* has reached a first threshold value (for example, 300 seconds). When the elapsed time is judged to have reached the first threshold value, the procedure proceeds to step a8, and when the elapsed time is judged not to have reached the first threshold value, step a7 is repeated.

At step a8, the rotation driving control portion 541*a* judges whether or not humidity data received by the humidity data reception portion 541*d* is a predetermined value (for example, 10%) or less. When the humidity data is judged to be the predetermined value or less, the procedure proceeds to step a9, and when the humidity data is judged to exceed the predetermined value, the procedure proceeds to step a10.

At step a9, when the humidity data is judged to be the predetermined value or less at step a8, the rotation driving control portion 541*a* judges whether or not the elapsed time measured by the elapsed time measuring portion 541*c* has reached a second threshold value (for example, 500 seconds). When the elapsed time is judged to have reached the second threshold value, the procedure proceeds to step a10, and when the elapsed time is judged not to have reached the second threshold value, step a9 is repeated.

At step a10, the rotation driving control portion 541*a* rotationally drives the charging section 51 so that the shield opening 511*a* of the charging section 51 is displaced from the position opposing to the adsorption opening 522 to the position opposing to the photoreceptor 3. The charging device 5 is thereby able to prepare so that the charging operation to charge the surface of the photoreceptor 3 is able to be performed smoothly.

Here, the generation amount of the discharge product generated in charging the surface of the photoreceptor 3 by the charging section 51 varies depending on the humidity condition in the vicinity of the charging section 51, and along with decrease of humidity, the generation amount of the discharge product increases. Contrary to this, the rotation driving control portion 541*a*, in the case where humidity data indicating humidity in the vicinity of the charging section 51 is a predetermined value of less, controls rotation driving of the charging section 51 so that the shield opening 511*a* is displaced from the position opposing to the discharge product adsorption removal section 52 to the position opposing to the photoreceptor 3 when the elapsed time measured by the elapsed time measuring portion 541*c* reaches the second threshold value exceeding the first threshold value. Thus, when the humidity data is the predetermined value or less, the elapsed time since the shield opening 511*a* is maintained at the position opposing to the discharge product adsorption removal section 52 is able to extend, and therefore, it is possible to sufficiently adsorb and remove the discharge product by the discharge product adsorption removal section 52 even in the case where humidity data is the predetermined value or less and a large amount of discharge product is retained in the inner space of the shield case 511.

Next, at step all, the exhaust control section 542 controls the exhaust driving section 531, and causes the exhaust section 53 to stop the exhaust operation to generate airflow. Then, at step a12, the charging control section 54 transmits the adsorption removal operation completion signal indicating that the adsorption removal operation by the discharge product adsorption removal section 52 is completed to the apparatus control section 21. The apparatus control section 21 that has received the adsorption removal operation completion signal completely cuts off the power source of the image forming apparatus 100.

Figure 9:
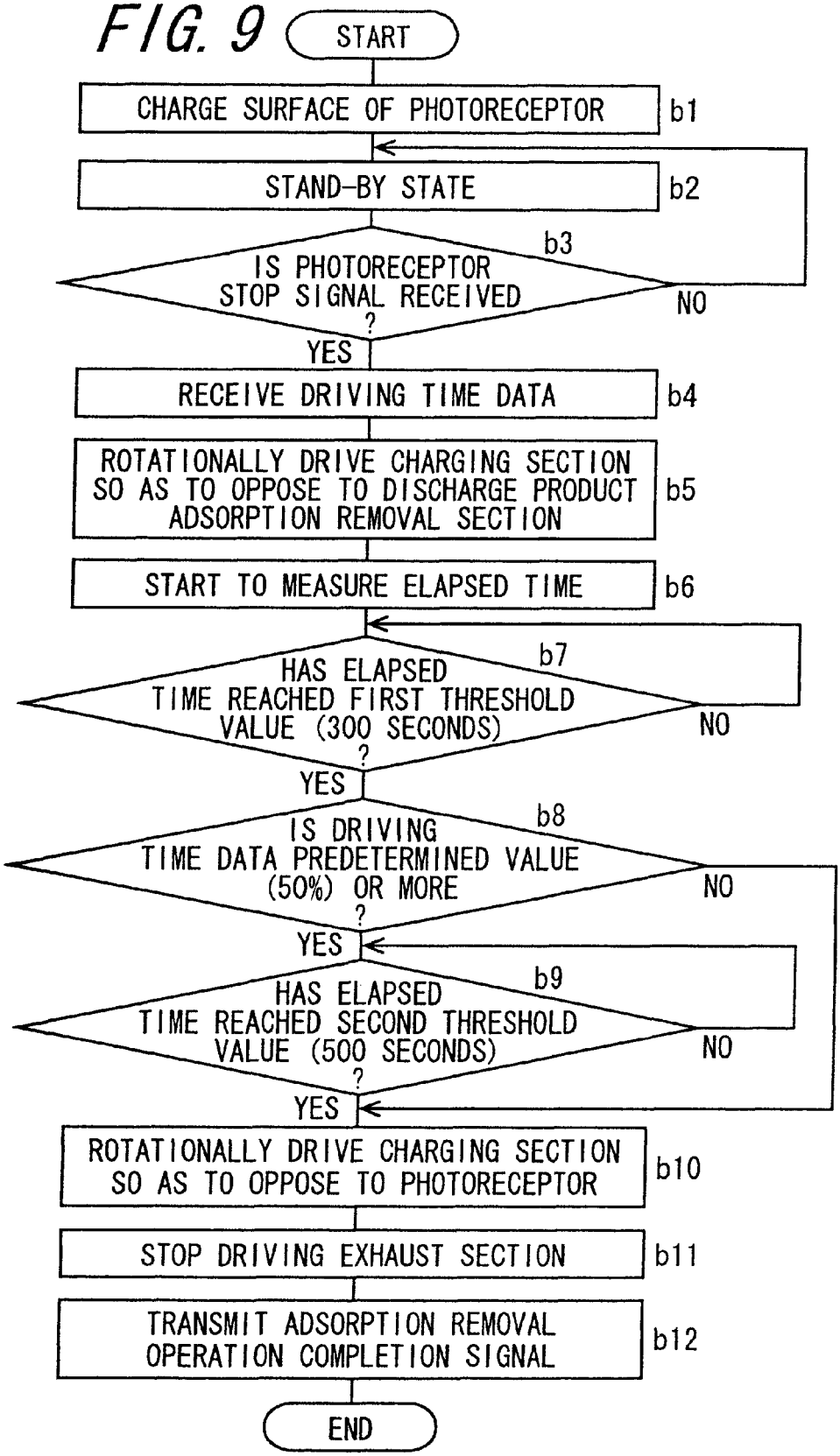
FIG. 9 is a flowchart showing a third example of the flow of the operation of the charging device.

FIG. 9 is a flowchart showing a third example of the flow of the operation of the charging device 5. The longer the time that the photoreceptor 3 is rotationally driven to charge the photoreceptor 3 is, that is, the longer the photoreceptor driving time is, the generation amount of the discharge product increases. Thus, it is preferable to control the adsorption removal operation of the discharge product by the discharge product adsorption removal section 52 depending on the photoreceptor driving time.

At step b1, the charging device 5 charges the surface of the photoreceptor 3 in the state where the shield opening 511*a* of the charging section 51 is maintained at the position opposing to the photoreceptor 3. At this time, the exhaust control section 542 controls the exhaust driving section 531, and causes the exhaust section 53 to continue the exhaust operation to generate airflow.

Next, at step b2, in accordance with a situation that the image forming operation at the image forming apparatus 100 is stopped to be in the stand-by state, the charging device 5 is in the stand-by state with the charging operation for the photoreceptor 3 stopped.

Then, at step b3, the rotation driving control portion 541*a* judges whether or not the stop signal reception portion 541*b* has received the photoreceptor stop signal. When it is judged that the stop signal reception portion 541*b* has received the photoreceptor stop signal, the procedure proceeds to step b4, and when it is judged that the photoreceptor stop signal has not been received, the procedure returns to step b2 to continue the stand-by state.

At step b4, the driving time data reception portion 541*e* receives driving time data. Then, at step b5, the rotation driving control portion 541*a* rotationally drives the charging section 51 so that the shield opening 511*a* of the charging section 51 is displaced from the position opposing to the photoreceptor 3 to the position opposing to the adsorption opening 522. The charging device 5 is thereby able to efficiently adsorb and remove the discharge product retained in the inner space of the shield case 511 by the discharge product adsorption removal section 52.

Next, at step b6, the elapsed time measuring portion 541*c* starts to measure the elapsed time since the shield opening 511*a* is maintained at the position opposing to the adsorption opening 522. Then, at step b7, the rotation driving control portion 541*a* judges whether or not the elapsed time measured by the elapsed time measuring portion 541*c* has reached a first threshold value (for example, 300 seconds). When the elapsed time is judged to have reached the first threshold value, the procedure proceeds to step b8, and when the elapsed time is judged not to have reached the first threshold value, step b7 is repeated.

At step b8, the rotation driving control portion 541*a* judges whether or not driving time data received by the humidity data reception portion 541*d* is a predetermined value (for example, 50%) or more. When the driving time data is judged to be the predetermined value or more, the procedure proceeds to step b9, and when the driving time data is judged to be less than the predetermined value, the procedure proceeds to step b10.

At step b9, the rotation driving control portion 541*a*, when judging that the driving time data is the predetermined value or more at step b8, judges whether or not the elapsed time measured by the elapsed time measuring portion 541*c* has reached a second threshold value (for example, 500 seconds). When the elapsed time is judged to have reached the second threshold value, the procedure proceeds to step b10, and when the elapsed time is judged not to have reached the second threshold value, step b9 is repeated.

At step b10, the rotation driving control portion 541*a* rotationally drives the charging section 51 so that the shield opening 511*a* of the charging section 51 is displaced from the position opposing to the adsorption opening 522 to the position opposing to the photoreceptor 3. The charging device 5 is thereby able to prepare so that the charging operation to charge the surface of the photoreceptor 3 is able to be performed smoothly.

Here, the longer the time that the photoreceptor 3 is rotationally driven to be charged, that is, the longer the photoreceptor driving time is, the generation amount of the discharge product increases. Contrary to this, the rotation driving control portion 541*a*, in the case where the driving time data is a predetermined value or more, controls rotation driving of the charging section 51 so that the shield opening 511*a* is displaced from the position opposing to the discharge product adsorption removal section 52 to the position opposing to the photoreceptor 3 when the elapsed time measured by the elapsed time measuring portion 541*c* reaches the second threshold value exceeding the first threshold value. Thus, when the driving time data is the predetermined value or more, the elapsed time since the shield opening 511*a* is maintained at the position opposing to the discharge product adsorption removal section 52 is able to extend, and therefore, it is possible to sufficiently adsorb and remove the discharge product by the discharge product adsorption removal section 52 even in a case where the driving time data is the predetermined value or more and a large amount of discharge product is retained in the inner space of the shield case 511.

Next, at step b11, the exhaust control section 542 controls the exhaust driving section 531, and causes the exhaust section 53 to stop the exhaust operation to generate airflow. Then, at step b12, the charging control section 54 transmits the adsorption removal operation completion signal indicating that the adsorption removal operation by the discharge product adsorption removal section 52 is completed to the apparatus control section 21. The apparatus control section 21 that has received the adsorption removal operation completion signal completely cuts off the power source of the image forming apparatus 100.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A charging device comprising:

a charging section for charging a surface of a photoreceptor which is provided to be rotatable about a rotation axis; and a discharge product adsorption removal section provided on a downward side in a vertical direction of the photoreceptor and having an adsorption layer composed of an adsorbent that adsorbs a discharge product generated in charging the surface of the photoreceptor by the charging section, the charging section including:

a shield case having a longitudinal axis parallel to the rotation axis of the photoreceptor and having a shield opening which faces and opens in one direction perpendicular to the longitudinal axis, a discharge electrode provided in the shield case in parallel with the longitudinal axis, and a rotation shaft to which the shield case is fixed and which is disposed to be rotatable about an axial line parallel to the longitudinal axis, and the rotation shaft being rotatable from a position where the shield opening opposes to the photoreceptor to a position where the shield opening opposes to the discharge product adsorption removal section.

2. The charging device of claim 1, wherein the charging section and the discharge product adsorption removal section are arranged side by side in this order downward in the vertical direction of the photoreceptor, and the charging section is rotated by 180° about the axial line of the rotation shaft and thereby the shield opening of the shield case is displaced from a position opposing to the photoreceptor to a position opposing to the discharge product adsorption removal section.

3. The charging device of claim 1, further comprising an exhaust section which generates airflow flowing from one end to another end in the rotation axis of the photoreceptor, wherein the discharge product adsorption removal section extends along the rotation axis of the photoreceptor and is formed into a case shape, and is configured to have an adsorption opening extending along the rotation axis of the photoreceptor to open, and airflow passage openings which open at both ends in its longitudinal axis parallel to the rotation axis of the photoreceptor and through which airflow generated by the exhaust section passes, and the adsorption layer is formed on a bottom surface facing the adsorption opening, and the rotation shaft is rotatable from the position where the shield opening opposes to the photoreceptor to the position where the shield opening opposes to the adsorption opening of the discharge product adsorption removal section.

4. The charging device of claim 1, wherein the adsorbent constituting the adsorption layer is zeolite.

5. The charging device of claim 4, wherein the adsorption layer has a thickness of 40 to 100 μm.

6. The charging device of claim 1, further comprising a rotation control section that controls rotation driving operation about an axis of the rotation shaft in the charging device, wherein the rotation control section includes:

a stop signal reception portion that receives a photoreceptor stop signal indicating an instruction to stop rotation driving operation of the photoreceptor, an elapsed time measuring portion that measures an elapsed time since the charging section is rotationally driven and the shield opening of the shield case is maintained at a position opposing to the discharge product adsorption removal section, and a rotation driving control portion that controls rotation driving of the charging section so that the shield opening is displaced from the position opposing to the photoreceptor to the position opposing to the discharge product adsorption removal section in the case where the stop signal reception section has received the photoreceptor stop signal, and so that the shield opening is displaced from the position opposing to the discharge product adsorption removal section to the position opposing to the photoreceptor in the case where the elapsed time measured by the elapsed time measuring portion reaches a predetermined first threshold value.

7. The charging device of claim 6, wherein the rotation control section further comprises a humidity data reception portion that receives humidity data indicating humidity in the vicinity of the charging section, and the rotation driving control portion, when the elapsed time measured by the elapsed time measuring portion reaches a first threshold value, judges whether or not the humidity data received by the humidity data reception portion is the predetermined value or less, and in the case of judging the humidity data to be the predetermined value or less, controls rotation driving of the charging section so that the shield opening is displaced from the position opposing to the discharge product adsorption removal section to the position opposing to the photoreceptor when the elapsed time measured by the elapsed time measuring portion reaches a predetermined second threshold value exceeding the first threshold value.

8. The charging device of claim 6, wherein the rotation control section further comprises a driving time data reception portion that receives driving time data indicating a photoreceptor driving time that the photoreceptor is rotationally driven, and the rotation driving control portion, when an elapsed time measured by the elapsed time measuring portion reaches a first threshold value, judges whether or not driving time data received by the driving time data reception portion is a predetermined value or more, and in the case of judging the driving time data to be the predetermined value or more, controls rotation driving of the charging section so that the shield opening is displaced from the position opposing to the discharge product adsorption removal section to the position opposing to the photoreceptor when the elapsed time measured by the elapsed time measuring portion reaches a predetermined second threshold value exceeding the first threshold value.

9. An image forming apparatus comprising:

a photoreceptor;

a charging device of claim 1 that charges a surface of the photoreceptor;

an exposure section that irradiates a signal light based on image information on the surface of the photoreceptor in a charged state to form an electrostatic latent image;

a developing section that develops the electrostatic latent image on the surface of the photoreceptor to form a toner image;

a transfer section that transfers the toner image onto a recording medium; and a fixing section that fixes the toner image transferred on the recording medium.

* * * * *